US010845043B2

(12) United States Patent
Tuchler

(10) Patent No.: US 10,845,043 B2
(45) **Date of Patent: *Nov. 24, 2020**

(54) TRACK LIGHTING SYSTEM

(71) Applicant: Chocolate Lighting Company Ltd, Herzlia B (IL)

(72) Inventor: Gideon Tuchler, Herzlia B (IL)

(73) Assignee: Chocolate Lighting Company Ltd, Herzila B (IL)

( * ) Notice: Subject to any disclaimer, the term of this patent is extended or adjusted under 35 U.S.C. 154(b) by 0 days.

This patent is subject to a terminal disclaimer.

(21) Appl. No.: 16/231,516

(22) Filed: Dec. 23, 2018

(65) Prior Publication Data

US 2019/0145614 A1 May 16, 2019

Related U.S. Application Data

(63) Continuation of application No. 15/993,717, filed on May 31, 2018, now Pat. No. 10,161,609, which is a (Continued)

(51) Int. Cl.
*F21V 21/35* (2006.01)
*F21S 8/02* (2006.01)

(Continued)

(52) U.S. Cl.
CPC ..... *F21V 21/35* (2013.01); *F21S 8/024* (2013.01); *F21S 8/026* (2013.01); *F21V 17/102* (2013.01);

(Continued)

(58) Field of Classification Search
CPC ..... F21V 21/35; F21V 21/04; F21V 21/30; F21V 21/048; F21V 17/02; F21V 17/16;

(Continued)

(56) References Cited

U.S. PATENT DOCUMENTS 3,295,093 A 12/1966 Neumann et al.
5,154,509 A 10/1992 Wulfman et al.

(Continued)

FOREIGN PATENT DOCUMENTS

DE 9301559 5/1993
DE 19826530 12/1999

(Continued)

OTHER PUBLICATIONS

Official Action dated Apr. 17, 2019 From the US Patent and Trademark Office Re. U.S. Appl. No. 15/551,664. (30 Pages).

(Continued)

*Primary Examiner* — Evan P Dzierzynski

(57) ABSTRACT

A system comprising track-mounted luminaires and track. In some embodiments, electrical power for illumination is accessed by a luminaire through electrified railing recessed within a relatively narrow slot of the track. In some embodiments, a mount is provided separately from and/or additional to the power slot; for example, a magnetic mount. Optionally luminaires are orientable to select a direction of illumination, while secured by the magnetic mount. The track is optionally mounted flush and/or recessed with a mounting surface such as a ceiling and/or wall. In some embodiments, a recessed surface of the track is formed with an arc. Optionally luminaires conform with the curvature of the arc. Additionally or alternatively, the track is at least partially masked and/or decorated, for example by plastering and/or a face plate.

20 Claims, 10 Drawing Sheets

Related U.S. Application Data continuation of application No. 15/551,645, filed as application No. PCT/IL2016/050189 on Feb. 17, 2016, now Pat. No. 9,989,228.

(60) Provisional application No. 62/117,021, filed on Feb. 17, 2015.

(51) Int. Cl.

| | |
|---|---|
| ***F21V 21/30*** | (2006.01) |
| ***F21V 17/10*** | (2006.01) |
| ***F21V 17/16*** | (2006.01) |
| ***F21V 21/04*** | (2006.01) |
| ***F21V 23/06*** | (2006.01) |
| ***F21V 23/02*** | (2006.01) |
| *F21S 8/06* | (2006.01) |
| *H01R 25/14* | (2006.01) |
| *F21V 15/01* | (2006.01) |

(52) U.S. Cl.

CPC ..... *F21V 17/105* (2013.01); *F21V 17/16* (2013.01); *F21V 21/04* (2013.01); *F21V 21/30* (2013.01); *F21V 23/02* (2013.01); *F21V 23/06* (2013.01); *F21S 8/061* (2013.01); *F21V 15/013* (2013.01); *F21V 21/048* (2013.01); *H01R 25/142* (2013.01)

(58) Field of Classification Search

CPC ..... F21V 17/105; F21V 23/06; F21V 23/02; F21V 15/013; F21S 8/024; F21S 8/026; F21S 8/061; H01R 25/142

See application file for complete search history.

(56) References Cited

U.S. PATENT DOCUMENTS

| | | | | |
|---|---|---|---|---|
| 6,540,372 | B2 | 4/2003 | Joseph | |
| 7,819,676 | B1 | 10/2010 | Cardoso et al. | |
| 8,348,492 | B2 | 1/2013 | Mier-Langner et al. | |
| 8,651,711 | B2 | 2/2014 | Rudisill et al. | |
| 8,851,717 | B2 | 10/2014 | Verbrugh | |
| 9,360,196 | B2 | 6/2016 | Nicieja et al. | |
| 9,958,114 | B2 | 5/2018 | Park | |
| 10,161,609 | B2 * | 12/2018 | Tuchler | F21S 8/026 |
| 2006/0262521 | A1 | 11/2006 | Piepgras et al. | |
| 2009/0080202 | A1 | 3/2009 | Friedman | |
| 2009/0168423 | A1 | 7/2009 | Miller | |
| 2009/0279298 | A1 * | 11/2009 | Mier-Langner | F21V 21/096 362/235 |
| 2010/0321929 | A1 | 12/2010 | Ramirez et al. | |
| 2013/0168809 | A1 * | 7/2013 | Yen | H01L 23/5227 257/531 |
| 2015/0226384 | A1 | 8/2015 | Park | |
| 2016/0359283 | A1 | 12/2016 | Stucchi | |
| 2018/0031217 | A1 | 2/2018 | Tuchler | |
| 2018/0066830 | A1 | 3/2018 | Tuchler | |
| 2018/0283664 | A1 | 10/2018 | Tuchler | |

FOREIGN PATENT DOCUMENTS

| | | |
|---|---|---|
| EP | 2657590 | 10/2013 |
| EP | 1955418 | 4/2014 |
| JP | 2009-140669 | 6/2009 |
| WO | WO 97/34352 | 9/1997 |
| WO | WO 2014/137142 | 9/2014 |
| WO | WO 2016/132361 | 8/2016 |
| WO | WO 2016/132362 | 8/2016 |

OTHER PUBLICATIONS

Communication Pursuant to Article 94(3) EPC Dated Aug. 10, 2018 From the European Patent Office Re. Application No. 16721509.4. (6 Pages).

Communication Pursuant to Article 94(3) EPC Dated Jun. 21, 2018 From the European Patent Office Re. Application No. 16721955.6. (4 Pages).

Ex Parte Quayle OA Dated Jan. 5, 2018 From the US Patent and Trademark Office Re. U.S. Appl. No. 15/551,645. (10 pages).

Informal Communication by Telephone on May 15, 2017 Dated May 23, 2017 From the International Preliminary Examining Authority Re. Application No. PCT/IL2016/050189. (3 Pages).

Informal Communication by Telephone on May 15, 2017 Dated May 23, 2017 From the International Preliminary Examining Authority Re. Application No. PCT/IL2016/050190. (3 Pages).

International Preliminary Report on Patentability Dated May 30, 2017 From the International Preliminary Examining Authority Re. Application No. PCT/IL2016/050189. (20 Pages).

International Preliminary Report on Patentability Dated May 30, 2017 From the International Preliminary Examining Authority Re. Application No. PCT/IL2016/050190. (14 Pages).

International Search Report and the Written Opinion dated Jun. 20, 2016 From the International Searching Authority Re. Application No. PCT/IL2016/050189.

International Search Report and the Written Opinion dated Jun. 20, 2016 From the International Searching Authority Re. Application No. PCT/IL2016/050190.

Notice of Allowance dated Aug. 24, 2018 From the US Patent and Trademark Office Re. U.S. Appl. No. 15/993,717. (10 pages).

Office Action dated Feb. 15, 2018 From the Israel Patent Office Re. Application No. 254050 and Its Translation Into English. (4 Pages).

Office Communication dated Nov. 30, 2018 From the US Patent and Trademark Office Re. U.S. Appl. No. 15/993,717. (4 Pages).

Written Opinion dated Jan. 30, 2017 From the International Preliminary Examining Authority Re. Application No. PCT/IL2016/050189. (10 Pages).

Written Opinion dated Jan. 30, 2017 From the International Preliminary Examining Authority Re. Application No. PCT/IL2016/050190. (10 Pages).

WAC Lighting "Installation Instruction: W Track Recessed 120V Flangeless. WT4-RTL, WT8-RTL, WT12-RTL", WAC Lighting, 8 P., Jul. 2014.

European Search Report and the European Search Opinion dated Jun. 5, 2019 From the European Patent Office Re. Application No. 19172951.6. (9 Pages).

Official Action dated Jan. 21, 2020 From the US Patent and Trademark Office Re. U.S. Appl. No. 15/551,664. (26 pages).

Applicant-Initiated Interview Summary dated Aug. 2019 From the US Patent and Trademark Office Re. U.S. Appl. No. 15/551,664. (3 pages).

Interview Summary dated Jul. 2, 2020 from the US Patent and Trademark Office Re. U.S. Appl. No. 15/551,664. (3 pages).

Official Action Dated Aug. 6, 2020 from the US Patent and Trademark Office Re. U.S. Appl. No. 15/551,664. (11 pages).

* cited by examiner

TRACK LIGHTING SYSTEM

RELATED APPLICATIONS

This application is a continuation of U.S. patent application Ser. No. 15/993,717 filed on May 31, 2018, which is a continuation of U.S. patent application Ser. No. 15/551,645 filed on Aug. 17, 2017, now U.S. Pat. No. 9,989,228, which is a National Phase of PCT Patent Application No. PCT/IL2016/050189 having International Filing Date of Feb. 17, 2016, which claims the benefit of priority under 35 USC § 119(e) of U.S. Provisional Patent Application No. 62/117,021 filed on Feb. 17, 2015.

The contents of the above applications are all incorporated by reference as if fully set forth herein in their entirety.

FIELD AND BACKGROUND OF THE INVENTION

The present invention, in some embodiments thereof, relates to the field of artificial illumination systems and more particularly, to systems for track lighting.

Track lighting systems provide means of selectably positioning and/or directing illumination; for example, according to the particular needs of an illuminated space. A typical track lighting system comprises track and luminaire components. Tracks support power distribution to and mechanical mounting of one or more luminaires at a plurality of positions (usually continuously) along their extent. Luminaires convert power to illumination, including determination of illumination parameters such as intensity, directionality, angle of spread and/or color.

Once mounted, track lighting systems allow flexibility in determining lighting conditions, and optionally allow changes according to changes in requirements. For example, luminaires are moveable along the track and/or re-orientable relative to the track. In some track lighting systems, luminaires attached to the track can be removed, added, and/or exchanged according to need.

The visual impact of the lighting system overall comprises the light provided, but also the appearance of the track, the luminaires, and their integration with their surroundings when mounted to a ceiling, wall, and/or other support member.

SUMMARY OF THE INVENTION

According to an aspect of some embodiments of the present invention, there is provided a track lighting track comprising a luminaire mounting surface having a concavity extending along an elongate track housing; wherein the concavity has an inset arcuate profile transverse to the track housing length, and wherein the inset arcuate profile is interrupted by an opening of a slot, also extending along the length of the track housing, which is further inset from the inset arcuate profile.

According to some embodiments of the invention, the slot is 8 mm or less in width.

According to some embodiments of the invention, the inset arcuate profile comprises an arc of a circle.

According to some embodiments of the invention, the track comprises a curved wall extending along the track and defining a surface of the inset arcuate profile; wherein a magnetically attracted material lines the curved wall.

According to some embodiments of the invention, the magnetically attracted material lines the curved wall on a side of the curved wall opposite the surface of the inset arcuate profile.

According to some embodiments of the invention, the track is configured for recessed mounting relative to a mounting surface of an architectural space.

According to some embodiments of the invention, the track comprises lateral mounting flanges receded by a distance from the mounting surface of the track about equal to the thickness of a standard mounting board.

According to some embodiments of the invention, the distance is sufficiently larger than the thickness of standard mounting board to receive a coating of material blending the appearance of the mounting surface of the track with an exposed surface of a mounting board when mounted thereat.

According to some embodiments of the invention, the slot includes at least one electrical conductor positioned to receive a contact from a power contact assembly of a luminaire and deliver electrical power therethrough.

According to some embodiments of the invention, the slot includes a region configured to receive and support weight of a luminaire, wherein the weight is transferred to the region through the power contact assembly.

According to some embodiments of the invention, the track includes at least one luminaire having a fixation portion with a convex arcuate profile that fittingly inserts to the concavity.

According to some embodiments of the invention, the fixation portion includes a power contact assembly configured to insert into the slot to receive electrical power therefrom.

According to some embodiments of the invention, the track includes at least one luminaire having a fixation portion which inserts to the concavity; the fixation portion including a material magnetically attracted to the magnetically attracted material lining the curved wall; and the magnetic attraction being sufficient to support at least 75% of the weight of the luminaire.

According to some embodiments of the invention, the magnetic attraction is between materials separated by at least 2 mm.

According to some embodiments of the invention, the magnetic attraction is between materials separated by at least a wall or ceiling surfacing material.

According to some embodiments of the invention, the magnetic attraction is between materials separated by at least a 2 mm thickness of aluminum.

According to some embodiments of the invention, the fixation portion of the luminaire is sized to fit inside the concavity; wherein a flat surface of the fixation portion is substantially flush to the mounting surface adjoining the concavity.

According to some embodiments of the invention, a housing of an illuminating module of the luminaire is sized to fittingly insert to the concavity when the fixation portion of the luminaire is inserted to the concavity; the orientation of the illuminating module relative to a longitudinal axis of the track being configurable from a plurality of orientations.

According to an aspect of some embodiments of the present invention, there is provided a track lighting system comprising: an elongate track housing; and a luminaire having a fixation portion configured for magnetic mounting to the track housing; wherein: the fixation portion includes a material magnetically attracted to a magnetically attracted material of the track housing, closest surfaces of the magnetically attracted materials of the track housing and the luminaire are separated by at least 2 mm when the luminaire is mounted to the track housing, and the magnetic attraction between the separated magnetically attracted materials is sufficient to support at least 75% of the weight of the luminaire.

According to some embodiments of the invention, the magnetic attraction is between materials separated by at least a wall or ceiling surfacing material.

According to some embodiments of the invention, the magnetic attraction is between materials separated by at least a 2 mm thickness of aluminum.

According to an aspect of some embodiments of the present invention, there is provided a luminaire for use with a track lighting system comprising: a housing having a convex track mounting surface comprising an arcuate cross-section; the luminaire also comprising a power contact assembly protruding from the convex mounting surface.

According to some embodiments of the invention, the power contact assembly is 8 mm wide or less.

According to some embodiments of the invention, the power contact assembly is 5 mm wide or less.

According to some embodiments of the invention, the power contact assembly is 3 mm wide or less.

According to an aspect of some embodiments of the present invention, there is provided a luminaire for use with a track lighting track, including a power contact assembly comprising a housing and at least one electrode having a tensioning means, the tensioning means being compressed by the housing, and a portion of the electrode being urged outward from the housing by the tensioning means; wherein the power contact assembly is sized to fit within a slot aperture extending along a track.

According to some embodiments of the invention, the slot aperture is 5 mm wide or less.

According to an aspect of some embodiments of the present invention, there is provided a track lighting track comprising: an elongate track housing; a slot in and extending along the housing, the slot including at least one electrical conductor positioned to receive a contact from a power contact assembly of a luminaire and deliver electrical power therethrough; wherein an aperture of the slot through which the power contact assembly is received is 8 mm wide or less along at least 90% of the track housing.

According to some embodiments of the invention, the aperture is 5 mm wide or less.

According to some embodiments of the invention, the aperture is 3 mm wide or less.

According to some embodiments of the invention, the aperture is 1 mm wide or less.

According to some embodiments of the invention, the housing is mounted along an exposed surface of an architectural space, such that the only portion of the housing visible from within the architectural space is the slot.

According to some embodiments of the invention, the track comprises a means for supporting the weight of a luminaire, wherein the support means is concealed behind the exposed surface.

According to some embodiments of the invention, the support means provides support by magnetic attraction to a luminaire.

According to some embodiments of the invention, a means for supporting the weight of a luminaire is located within the slot at a position where it contacts a portion of the power contact assembly.

According to an aspect of some embodiments of the present invention, there is provided a luminaire for a track lighting system comprising: a plurality of locking members offset from each other along the length of a mounting assembly, wherein the locking members are sized, shaped and sufficiently flexible for fittingly passing into a slot of a track 5 mm wide or less; each locking member comprising a surface which lockingly engages one wall of the slot upon complete insertion into the slot; and wherein at least two of the plurality of locking members engage opposite walls upon the insertion to resist extraction from the slot by a force of the weight of the luminaire.

According to some embodiments of the invention, the region of locking engagement comprises a surface sloped toward the opening of the slot as the sloped surface approaches the slot.

According to some embodiments of the invention, the slope of the sloped surface is angled to translate force operating to pull the luminaire free of the slot into a lateral motion of the lockingly engaging surface, and wherein a force with which the lockingly engaging surface resists the lateral motion is overcome to free the engaging surface of engagement with the wall of the slot when the pulling force is about three times larger than the force of the weight of the luminaire on the locking member.

According to some embodiments of the invention, the region of locking engagement comprises a surface which retains the locking member by friction.

According to an aspect of some embodiments of the present invention, there is provided a method of mounting and unmounting a luminaire to a track lighting system comprising: pushing a luminaire straight into a slot of a track, thereby locking the luminaire in place; pulling a luminaire in a direction straight outward from the slot, thereby releasing the luminaire from the locking; and extracting the unlocked luminaire the rest of the way out of the slot.

According to some embodiments of the invention, the pulling is with a force of between three to five times the force of the weight of the luminaire.

According to an aspect of some embodiments of the present invention, there is provided a track lighting system comprising: an elongated track; and a luminaire having a luminous element located at a longitudinal position along the track when the luminaire is coupled to the track; wherein the luminaire comprises at least one magnet magnetically attracted to a material of the track; and wherein the magnet is located at the longitudinal position, and within 10 mm of the luminous element.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon. Implementation of the method and/or system of embodiments of the invention can involve performing or completing selected tasks manually, automatically, or a combination thereof. Moreover, according to actual instrumentation and equipment of embodiments of the method and/or system of the invention, several selected tasks could be implemented by hardware, by software or by firmware or by a combination thereof using an operating system.

For example, hardware for performing selected tasks according to embodiments of the invention could be implemented as a chip or a circuit. As software, selected tasks according to embodiments of the invention could be implemented as a plurality of software instructions being executed by a computer using any suitable operating system. In an exemplary embodiment of the invention, one or more tasks according to exemplary embodiments of method and/or system as described herein are performed by a data processor, such as a computing platform for executing a plurality of instructions. Optionally, the data processor includes a volatile memory for storing instructions and/or data and/or a non-volatile storage, for example, a magnetic hard-disk and/or removable media, for storing instructions and/or data. Optionally, a network connection is provided as well. A display and/or a user input device such as a keyboard or mouse are optionally provided as well.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example, and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1A:
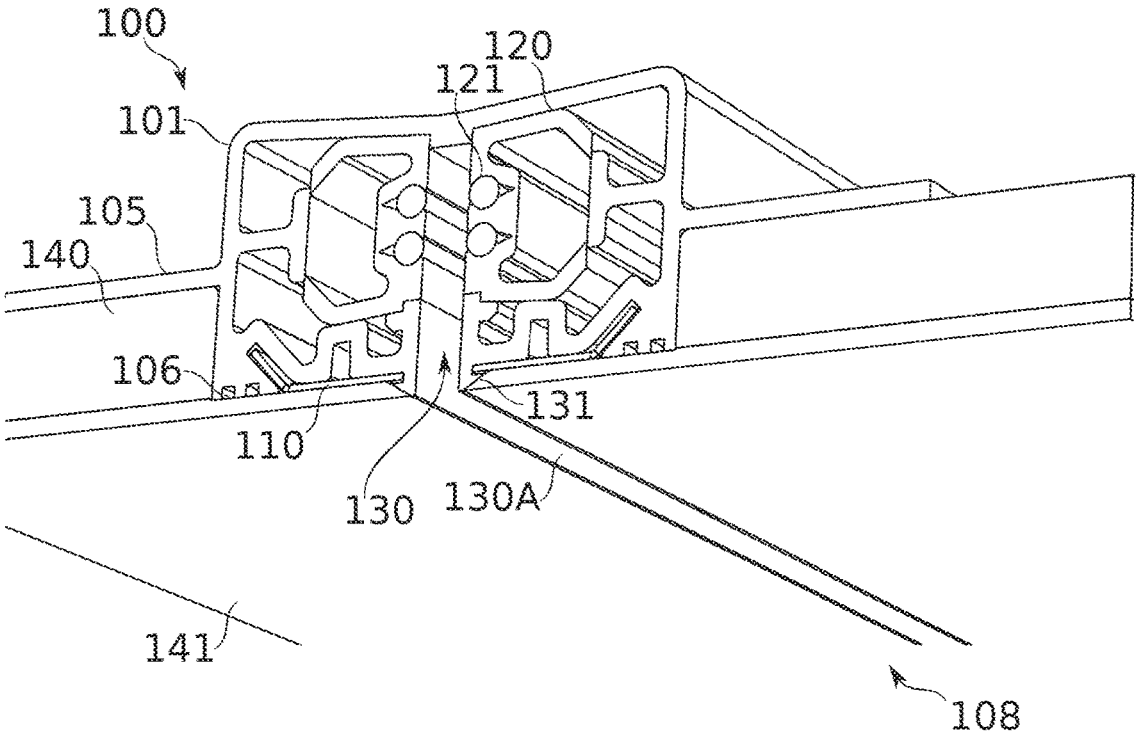
FIG. 1A is a schematic perspective view of a track for a recessed track lighting system comprising a narrow power access slot and a magnetically attracted mounting strip; for power delivery and mechanical support, respectively, of a luminaire, according to some exemplary embodiments of the invention.

The present invention, in some embodiments thereof, relates to the field of artificial illumination systems and more particularly, to systems for track lighting.

Overview

An aspect of some embodiments of the current invention relates to track lighting systems providing electrical power via a recessed slot having a width and/or an aperture width of about 1-8 mm or less. In some embodiments, the slot and/or slot aperture width is, for example, about 5 mm, 4 mm, 3 mm, 2 mm, 1 mm, or another greater, lesser, or intermediate width. In some embodiments, the slot extends along the track with the designated width for at least 90% of the slot length, and/or at least 90% of the length of the track housing.

In some embodiments, the track is provided with mounting means that allow recessed installation. For example, the track is shaped to be mounted with a surface flush or almost flush to a ceiling, wall, or other flat surface. Optionally, the track comprises one or more surfaces which can be covered with material (spackling paste and/or paint, for example) that visually blends the track with the surrounding mounting surface.

A potential advantage of recessed mounting is to reduce the obtrusiveness of the lighting system: of the track portion of the system, and/or of a luminaire which the track is suited to accommodate. In particular, recessed mounting hides from view means of mechanical support and electrical power supply which the track supplies. This is a potential advantage, for example, in lighting applications where control of aesthetics is valued at a premium.

However, luminaires still need to access these functions. In a typical recessed track lighting installation, access is through a slot, the opening of which is itself exposed to view—potentially posing a remaining undesired aesthetic distraction. A narrower slot provides a potential advantage for reduced obtrusiveness of the track system, particularly if coupled with recessed mounting. In some range of sizes (for example, from less than around 3-5 mm, depending on distance and other mitigating factors), the casual perception of a sufficiently narrow slot potentially converts to that of a generic construction feature such as a panel join, if it is noticed at all.

Despite the advantages of a narrower track slot, it is typically required of a design that the physical mounting and the electrical contact made by a luminaire will be both reliable and reversible not just at one location (as for a standard wall plug), but at any location along a significant length, and most likely at a plurality of arbitrary locations along that length simultaneously. A sufficiently reduced slot size, where the slot is required to handle all these functions, potentially impairs one or more of them functions beyond acceptable limits. For example, minimum thicknesses, strengths, clearances, flexing distances, and/or other design parameters potentially come into conflict.

In some embodiments of the present invention, electrical connection and physical (weight-supporting) mounting to a track lighting system are decoupled from one another by a physical separation of these functions, while retaining only a single slot as the visual manifestation of the installation. In some embodiments, this comprises providing a magnetic mounting to an outside (exposed surface-facing) portion of the track, simultaneously with electrical connection recessed from view within the slot. A potential advantage of a magnetic mounting arrangement is to reduce the number of conflicting requirements imposed on the structure of the slot. Potentially, this allows the slot to be built to a thinner dimension without impairing function and/or reliability. In some embodiments, the electrical interface portion of a luminaire (the part which inserts into the slot) is made correspondingly narrower in width and/or shorter along the slot. For example, the inserting electrical interface portion is about 1 mm wide, about 3 mm wide, about 5 mm wide, or another greater, smaller, or intermediate width. Optionally, the interface portion is or card-like, extending for a distance along the slot which is several times the width of the slot (for example, 5-10, 8-12, 10-15 times or another range of multiple having the same, greater, smaller, and/or intermediate bounds). Optionally, the interface portion is about the same length as width, for example, reduced to a square cross-section that can insert in four different orientations to the slot, or to a higher-sided polygonal or circular form allowing a larger number of orientations relative to the slot's longitudinal axis. It is to be understood that electrodes in such embodiments are optionally provided which extend around one or more sides, and/or placed at a plurality of levels (depths within the slot) in order to ensure contact with power-providing conductors at each active orientation of the luminaire. In some embodiments of the invention, electrical contact with a power-carrying conductor is made at a relatively deep depth within the slot compared to its width, for example, five or more times the width of the slot. In some embodiments, the power-carrying conductor is more shallowly located. Optionally, for example, one or more power conductors are provided at a lip of the slot. In such a case, the slot itself is optionally vestigial, for example, formed simply of the gap between two conductors.

In some embodiments, electrical connection and physical (weight supporting) mounting to a track lighting system co-exist within the slot. One of the requirements of an in-track mounting system, for many installations, is that a luminaire should be insertable and removable directly from any chosen point along the track. However, very thin slots (for example in the 1-5 mm range, or less), are difficult to provide with reliable and functional controls for mount locking/unlocking. In some embodiments of the present invention, a locking mechanism is provided which is configured to activate automatically upon proper positioning, and to unlock upon exertion of a sufficient force. The sufficient force is optionally selected to be enough greater than the weight of a luminaire that the mounting is secure, while being low enough that removal does not damage the track installation or luminaire. For example, in some embodiments, the removal force is set to be within about 3-5× the weight of the luminaire.

Particularly with the narrowest slots (3 mm or less, for example), another potential problem arises, in that a locking member, even if thin enough to insert to the slot, should nevertheless be thinner still at some point to provide enough edge to sufficiently engage a locking surface inside the slot—while being constructed solidly enough to exert force, and/or to insert and extract without damaging the locking mechanism. In the case of a friction mount (where resistance to weight is by frictional pressing against a surface), there may not be thinning of the locking member required, but the robustness of the lateral force is potentially yet more important. In some embodiments of the invention, one or more pairs of separate members are provided which alternate orientation along the length of the mounting interface, facing to and engaging upon opposite side of the slot. Potentially, this in effect allows the mount to be built with robustness equivalent to about twice the thickness which is actually available.

An aspect of some embodiments of the current invention comprises magnetic mounting of a luminaire to a track, the magnetic materials of the mounting being separated by one or more thicknesses of material relatively insusceptible to magnetism.

Magnetic mountings for use with exposed track lighting systems are described, for example, in U.S. Pat. No. 5,154,509 and U.S. Patent Publication 2009/0279298. However, these mountings are not adapted for use with a recessed track lighting system. For example, each relies on magnets used in direct contact with the surface of an attracted material (in the case of U.S. Patent Publication 2009/0279298, the contact is also used for heat dissipation), which is not generally available for a recessed mounting system with an appearance blended into the mounting surface.

In some embodiments of the current invention, luminaires are mounted to a track by the use of magnets and/or magnetically attracted materials. For example, a luminaire is provided with one or more permanent magnets (for example, rare earth magnets, or more particularly, neodymium-alloy magnets), while a track is provided with a magnetically attracted material such as steel. Alternatively or additionally, the positioning of magnetic and magnetically attracted elements is reversed.

In some embodiments, the luminaire contains a sufficient quantity and concentration of magnetic and/or magnetically attracted material to provide holding strength through the layers of aluminum, spackling paste, and/or other material which provide the decorative surfaces of the illumination system. In some embodiments, the holding strength bridges a gap maintained by differences in the shapes of the most closely apposed surfaces of the luminaire and track. The supporting magnetic field is, for example, sufficient to provide a safety factor of 5× or more over the attractive strength required to secure the luminaire against its own weight. In particular, it is a potential advantage for a magnetic mounting system to bear weight even through a thickness of aluminum, since, although aluminum is not magnetically attracted to a sufficient degree for use in mounting, its use provides a potential advantage otherwise by allowing relatively low-cost extruded production of axially extended members having a complex cross section. The weight which can be borne by a magnetic mounting system is, for example, at least 75% of the weight of the luminaire, at least 100%, at least 200%, at least 300%, at least 500%, or another greater, smaller, and/or intermediate weight.

In some embodiments, the (possibly damaging) exertion of magnetic force against an exposed extent of a friable surface such as plaster or spackling compound is reduced by the provision of a narrow region (for example, a peak, or another region of 1 mm width or less) which closely approaches and/or protrudes from the friable surface, to support a region which substantially bears the forces of magnetic attraction.

An aspect of some embodiments of the current invention comprises the paired use of half-locking members, to provide mounting connection of a luminaire to a recessed track lighting system.

In some embodiments, locking members are each "half-locking" in that each engages only one wall of a slot, each member of a pair engaging a wall opposite the other. Optionally, the half-locking members are offset from each other along the length of the track. Potentially, this allows a locking design requiring a single slot's thickness of material to securely engage even a single wall to be effectively applied to two walls.

An aspect of some embodiments of the current invention comprises the use of locking members which automatically lock upon insertion, and automatically unlock without damage upon exertion of sufficient removal force.

In some embodiments, the sufficient removal force is in the range of about 3×-5× the weight of the supported luminaire, for example, 3×, 4×, 5×, or another greater, lesser, or intermediate multiple. In some embodiments, the unlocking comprises providing a sloped locking surface inside the slot, the incline of the slope being selected to convert downward force into lateral force that—upon a selected force being exerted—guides the locking member into an unlocked position. Optionally, the slope is on the locking member. Optionally or additionally, the slope is on a surface that the locking member engages.

In some embodiments, unlocking without damage comprises, for example, ability to reliably complete a duty cycle of 5, 10, 25, 50, 100, or another greater, lesser and/or intermediate number of insertions and removals without losing the ability to stably support a luminaire.

An aspect of some embodiments of the current invention comprises an elongated, transversely and concavely arcuate holding surface for a luminaire along a recessed track.

In some embodiments, the track comprises an elongated, inset region within which a portion of the luminaire body is received; the inset region being itself arcuate across its width. Optionally, a portion of the luminaire body is received along at least 90% of the length of the luminaire. Additionally or alternatively, the received portion of the luminaire body comprises a housing fittingly received to the surface of the inset region, from which housing an elongate connection rod and/or wire extends to an illuminating portion of the luminaire. Optionally, the housing is received along at least 90% of the housing length. Optionally, the inset region is wider than a slot which is provided for electrical power axis. Optionally, the slot aperture is located along the surface of the inset region.

A potential advantage of a slotted arcuate surface is to reduce the obtrusiveness (protrusion distance) of a mounted luminaire. It should be noted that this is in exchange for a change in the surface characteristics (in particular, an indentation) of the mounting surface, beyond a single slot.

However, even in this respect, an arcuate inset profile (optionally slotted) provides a potential advantage over a slot alone, in that the surface slope change is more gradual. Thus, shading changes along the track length are potentially less obtrusive than those of a slot, even if the width is wider, particularly if care is taken to appropriately illuminate the inset region itself. Optionally, the arcuate inset region of the track is colored to match the surrounding surface; for example, an aluminum surface is powder coated to match a specification of a wall or ceiling coloration. Potentially, the inset shape helps the track slot to take on the appearance of a decorative feature, for example, by presenting a form which is less obviously utilitarian than a raw slot.

An aspect of some embodiments of the current invention is a magnetic mount, wherein the magnetic material is installed axially alongside and within about 15 mm of the luminous elements of a magnetically mountable luminaire.

In some embodiments of the current invention, luminous elements and magnets to for mounting are provided within about 15 mm of each other. In some embodiments, the elements are within about 10-20 mm, about 10-15 mm, about 5-15 mm, about 5-10 mm, about 0-5 mm, or within another range of distances having the same, larger, smaller, and/or intermediate bounds. A potential advantage of a short magnet-luminaire distance is that magnetic mounting and luminosity can be provided along the same length of a luminaire (allowing, for example, an optionally higher amount of magnetic material to be added), while the luminaire itself remains relatively low profile.

In some embodiments, for example, a cross section of a luminaire and/or of a luminaire mounting portion comprises a 15 mm radius half-circle, or a curve of another radius, for example, 10 mm, 20 mm, 25 mm, or another greater, lesser, and/or intermediate radius. In an exemplary arrangement, illuminating elements are optionally provided about centered on the radiating surface of the luminaire (slightly inset from the half-circle diameter, for example), while the magnetic mounting elements are provided spaced about 3-4 mm from the circumferential portion of the half-circle. Assuming reasonable element thicknesses, where magnet and illuminating element are provided within the same cross section, the minimum distance between magnet and illuminating element is thus about 10 mm or less, in some embodiments.

Before explaining at least one embodiment of the invention in detail, it is to be understood that the invention is not necessarily limited in its application to the details of construction and the arrangement of the components and/or methods set forth in the following description and/or illustrated in the drawings. The invention is capable of other embodiments or of being practiced or carried out in various ways.

Track with Flat Mounting Surface, and Mating Luminaire Designs

Figure 1B:
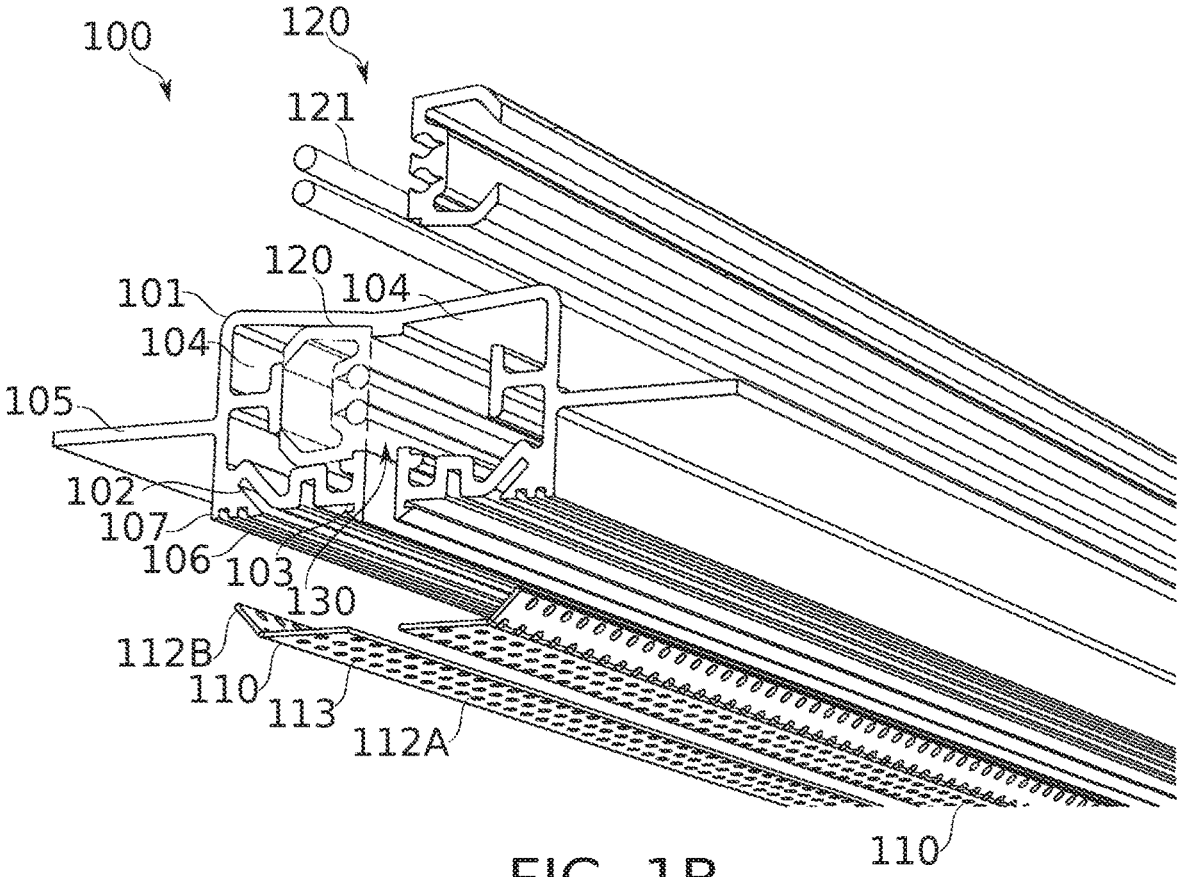
FIG. 1B is a partially exploded schematic perspective view of the track of FIG. 1A, according to some exemplary embodiments of the invention.

Reference is now made to FIG. 1A, which is a schematic perspective view of a track 100 for a recessed track lighting system comprising a narrow power access slot 130 and a magnetically attracted mounting strip 110, for power delivery and mechanical support, respectively, of a luminaire, according to some exemplary embodiments of the invention. Reference is also made to FIG. 1B, which is a partially exploded schematic perspective view of the track 100 of FIG. 1A, according to some exemplary embodiments of the invention.

In some embodiments of the invention, track 100 comprises track housing 101. Optionally, track housing 101 comprises an extruded aluminum manufacture. In some embodiments, track housing 101 comprises an interior region 130 formed as a slot open through aperture 130A in a ventral side of the track 100 (the ventral side being considered as the side of the track 100 facing the exposed mounting surface 108). In some embodiments, the walls of slot 130 comprise surfaces of one or more contact assemblies 120 carrying power rails 121 for bringing power to contacts of a luminaire. For example, the track 100 comprises two contact assemblies 120, each carrying two power rails 121. The contact assemblies 120 occupy corresponding receiving spaces 104 within the track housing 101.

A narrow slot 130 is provided in some embodiments of the invention, for example, a slot having a width in the range of 1-8 mm; more particularly, about 5 mm, about 3 mm, about 1 mm; or another larger, smaller, and/or intermediate value. Slots of this narrowness are a potential advantage for allowing the appearance of a space to be designed for flexible positioning of lighting with lowered impact on appearance by the lighting infrastructure itself. Apart from being visually thinner, a narrower slot potentially reduces the deepest extent of shadowing visible at most view angles.

In some embodiments of the invention, track 100 comprises one or more mounting elements 110; the mounting elements 110 being formed, for example, as plates which extend along a luminaire mounting surface 108 of the track 100. In some embodiments of the invention, mounting element 110 comprises a magnetically attracted material such as steel or another iron alloy. Optionally inset 110 is itself magnetized. In some embodiments, track housing 101 itself comprises a magnetically attracted and/or magnetized material. However, it is a potential advantage to provide inserts 110 as pieces separate from track housing 101, to allow taking advantage of technologies of manufacture using non-magnetic materials (for example aluminum extrusion) in the formation of the profile of the track body.

It is to be understood that mounting elements 110 are optionally provided in different variations of construction consistent with the provision of sufficient magnetically susceptible material, positioned to allow reliable support of a mounted luminaire. Optionally, mounting elements 110 incorporate other functionality. For example, in some embodiments, mounting elements 110 include construction features for securing to the track housing 101, and/or related to installation of the track 100.

In some embodiments, track housing 101 includes one or more mounting element slots 102, 103 shaped to receive at least a portion of the mounting element 110, for positioning and/or securing of the mounting element 110 to the track housing 101. For fitting to slots 102, 103, for example, mounting element 110 comprises an angle bend along a longitudinal axis of the track 100, the bend connecting plate regions 112A and 112B. During assembly, the plate regions 112A, 112B optionally insert into one side of the two slots 102, 103, and slide along the track housing 101. In this example, slots 102, 103 are positioned such that the resulting assembly positions a portion of plate 112A on an outermost surface of the track 100, at and/or close to luminaire mounting surface 108. This is a potential advantage for providing increased strength and/or reduced magnetic material requirements for mounting. However, in some embodiments, a mounting element is held entirely within a track housing (as illustrated, for example, for mounting element 210 in track body 201, in relation to FIGS. 3A-3B hereinbelow).

Figure 5A:
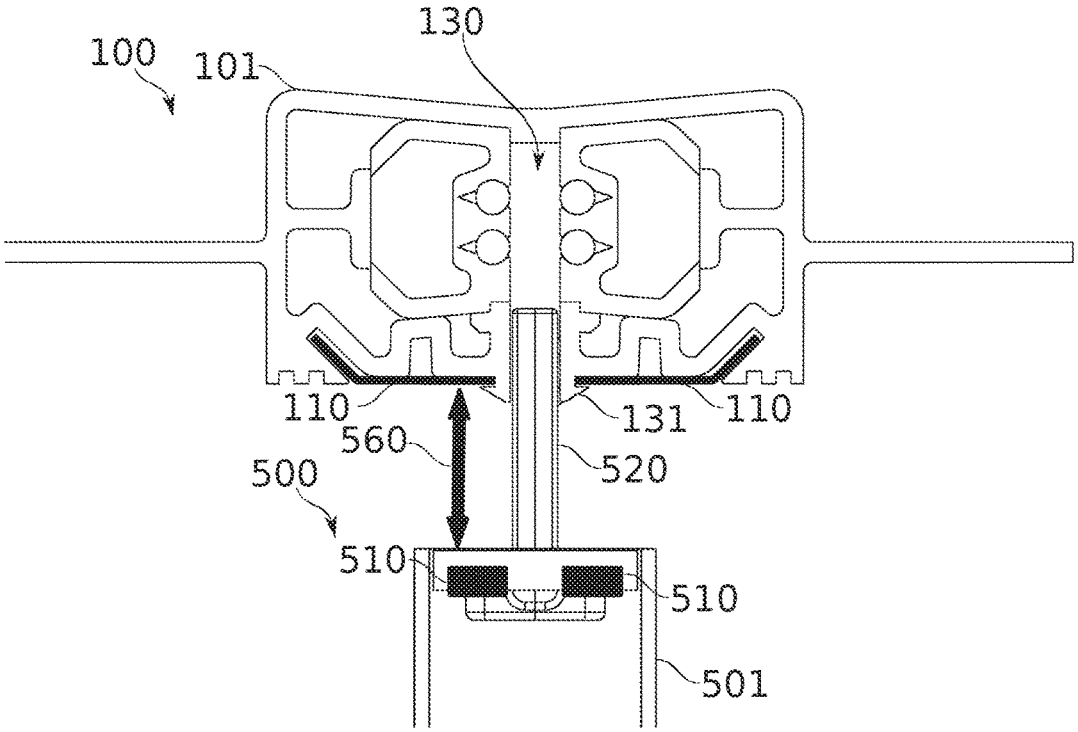
FIG. 5A shows relationship between magnetically susceptible mounting elements of a track, and corresponding magnetically susceptible mounting elements of a luminaire, according to some exemplary embodiments of the invention.
Figure 9A:
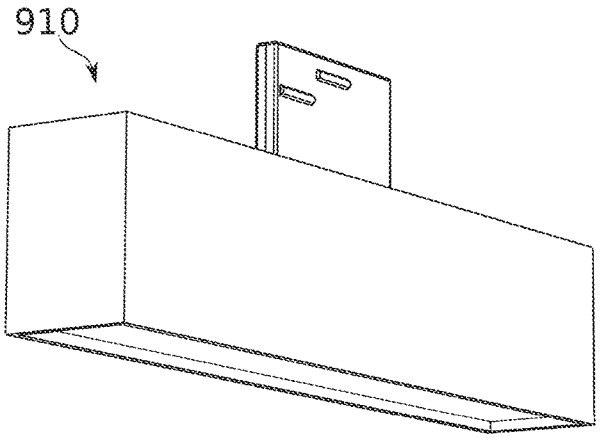
FIG. 9A shows a schematic view of a luminaire shaped for use with a track, according to some exemplary embodiments of the invention.

Reference is now made to FIG. 5A, which shows relationship between magnetically susceptible mounting elements 110 of a track 100, and corresponding magnetically susceptible mounting elements 510 of a luminaire 500, according to some exemplary embodiments of the invention. Reference is also made to FIG. 9A, which shows a schematic view of a luminaire 910 shaped for use with a track 100, according to some exemplary embodiments of the invention.

In some embodiments, a luminaire 500 comprises one or more mounting elements 510 which are positioned on and/or within the housing 501 of the luminaire 500. In some embodiments, mounting elements 510 comprise magnets (for example, rare earth magnets) which are attracted to the magnetically susceptible material of mounting elements 110. Luminaire 910 of FIG. 9A provides a perspective view of a luminaire having a flat top surface adapted to mate with track 100.

In some embodiments, mounting is by inserting power contact assembly 520 into slot 130, then shortening the distance 560 until magnetic attraction between elements 110 and 510 is sufficiently strong to close the gap and/or maintain the position. It should be noted that the relative positions of the luminaire 500 and the track 100 is controlled, in some embodiments, by a protruding member 131. Magnetic interactions at this smallest distance determine the available holding strength.

In some embodiments of the invention, mounting elements 110 are provided with surface irregularities 113; for example, perforations 113 and/or another irregularity such as divots, bumps, and/or ridges. In some embodiments, the irregularities are spaced at regular or irregular intervals of about 1-10 mm, or at another greater or lesser interval. A potential advantage of surface irregularities 113 is for increasing the stability of adhesion of a surface treatment (for example, spackling paste) applied during installation to an exposed surface of the mounting element 110. It should be noted that potential mechanical damage to a surface treatment (for example, due to magnetic attraction forces and/or sliding of the luminaire) is limited, in some embodiments, by keeping the fill-in level to a thickness less than or equal to the distance which protruding member 131 stands proud of the ventral side of the track.

In some embodiments, track 100—optionally, track housing 101 in particular—comprises one or more additional features adapted to support incorporation with surrounding materials for mounting. Shown in FIGS. 1A-1B, for example, is flange 105, which is spaced back from the ventral side of the track 100 to allow flush or nearly flush mounting with, for example, a standard thickness of mounting board such as wallboard, ceiling board, or other architectural mounting surface 140 of an architectural space (for example, a hall, room, courtyard or other space defined by a building). Such a standard thickness is, for example, about 6.4 mm, 7.9 mm, 9.5 mm, 12.7 mm, 15.9 mm, 19.0 mm, 25.4 mm, another thickness of within about 5-30 mm, or another greater or lesser thickness. In some embodiments, a portion of the ventral face of the track 106 is provided with surface irregularities 107, for example, ridges (as shown), or another irregularity such as divots, bumps, or perforations (spaced, for example, at regular or irregular intervals of about 1-10 mm, or another greater, lesser, or intermediate interval). A ridged irregularity with ridges running longitudinally along the track is optionally used, for example, to accommodate an extruded aluminum construction of the track housing 101. Potentially, irregularities 107 help to improve binding of a surfacing material 141 such as spackling paste to the track body 101.

In some embodiments, the form of track housing 201 is provided with one or more installation features such as brackets, holes, slots, or other forms which can be attached to by mounting hardware and/or surfaces.

Figure 2:
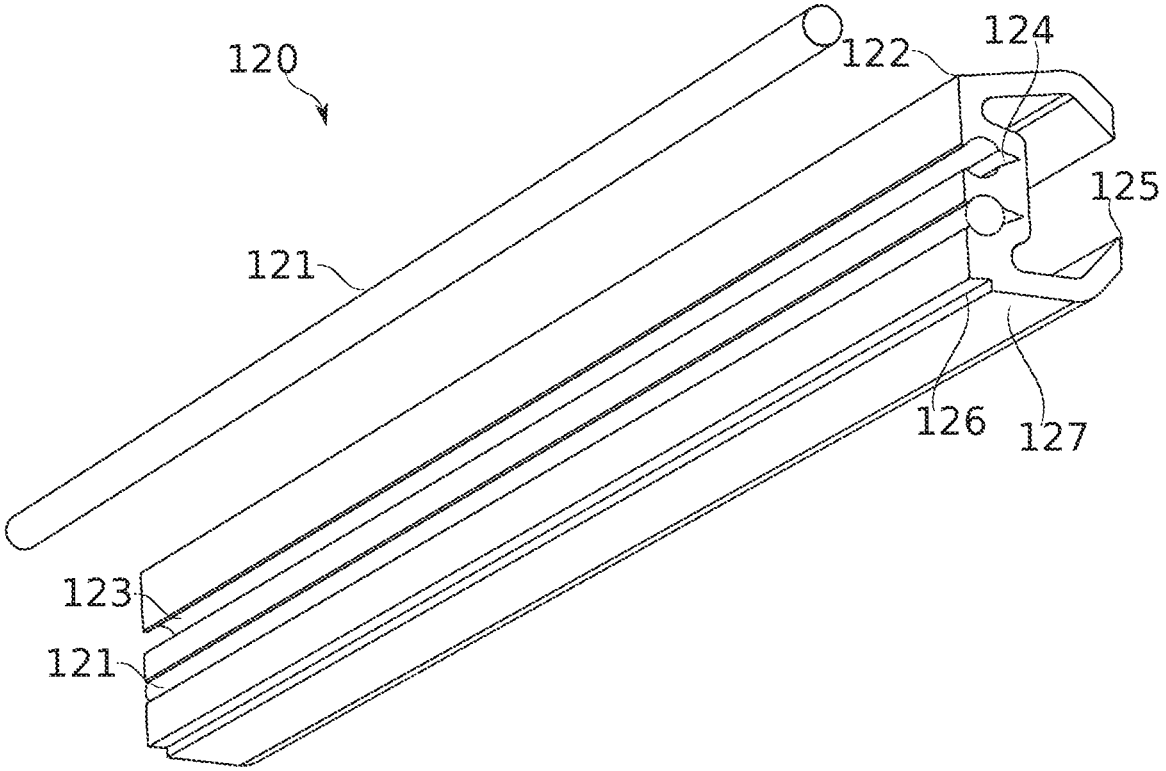
FIG. 2 is a partially exploded schematic view of a contact assembly, according to some exemplary embodiments of the invention.

Reference is made to FIG. 2, which is a partially exploded schematic view of a contact assembly 120, according to some exemplary embodiments of the invention.

In some embodiments, each contact assembly 120 comprises one, two, or more power rails 121. Arrangements of power connections to power rails 121 is described, for example, in relation to FIG. 5B, hereinbelow. In some embodiments, a power rail 121 is fitted to a housing 122 of a contact assembly 120 within a rail receiving slot 123. In some embodiments, housing 122 comprises an insulating material such as a plastic resin, for example, a polycarbonate resin. Optionally, the insulating rail element is manufactured by an extrusion method. In some embodiments, the resin is chosen with sufficient flexibility to allow a snap fit to be obtained after housing 122 inserts into the receiving space 104 of the track housing 101. For example, the housing 122 is inserted to the receiving space 104 in a loose position within the housing cross-section, and afterward manipulated to a snap-fitted position.

In some embodiments, the resin (such as polycarbonate) is chosen for a relatively high electrical resistance, high resistance to heat deformation and/or low flammability. In some embodiments, a contact assembly 120 comprises surfaces sized and shaped for interacting with the surfaces of track housing 101 for positioning and/or locking of the contact assembly 120 within the receiving space 104, for example, surfaces 125, 126, and/or 127. With respect to surface 125, it is noted that it is a potential advantage for manufacture to provide surfaces of the contact assembly 120 which are positioned to interact flexibly (through bending of the arm comprising surface 127, for example) and over a relatively small cross-section (defined, for example, by the overlap between surface 125 and the portion of housing 101 which it contacts), so as to reduce the chances of interference between housing 101 and contact assembly 120 when the contact assembly 120 is inserted into its receiving space 104. For example, interference is reduces sufficiently so that contact assembly 120 can be optionally push-inserted to a distance of about 5 meters (or a greater or lesser length) during the manufacture of an assembled length of track.

Optionally, rail receiving slot 123 further comprises a flexing cut 124. Flexing cut 124 provides a potential advantage for insertion of rail 121 to slot 123 by opening to allow pressure from rail 121 to force open slot 123 upon being pressed thereto during assembly.

Figure 5B:
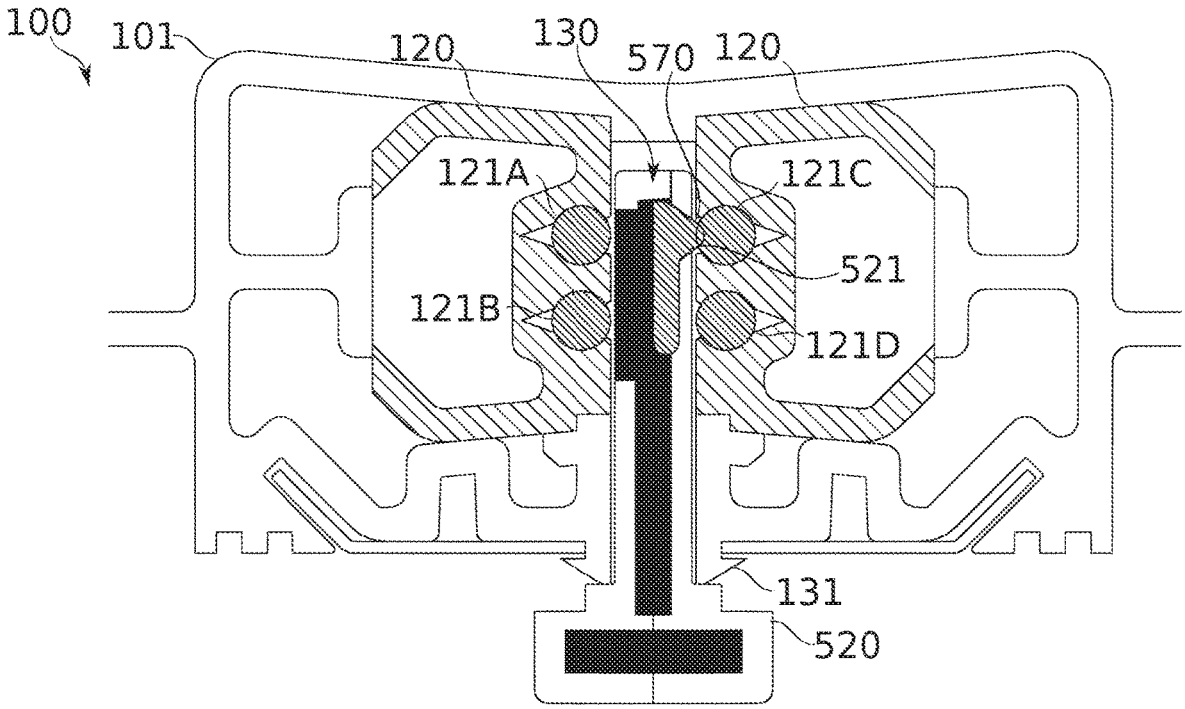
FIG. 5B shows electrical contacts between one or more contact assemblies of a track and a power contact assembly of a luminaire, according to some exemplary embodiments of the invention.
Figure 6:
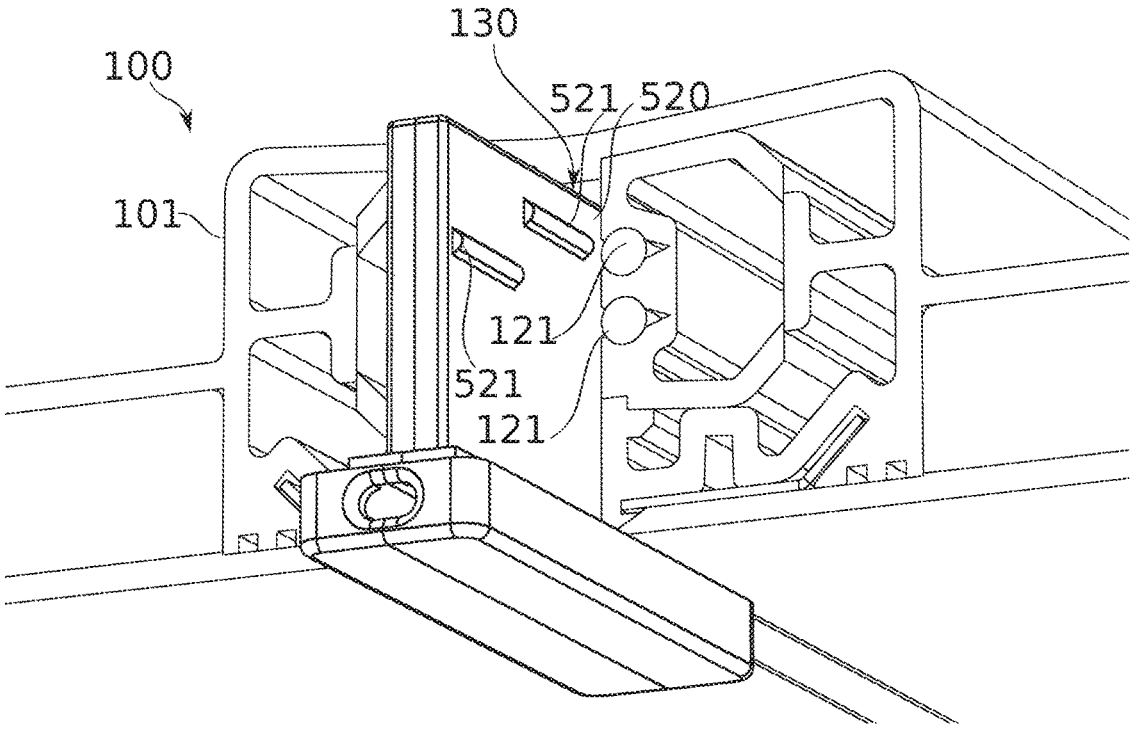
FIG. 6 shows electrical contacts of a track and luminaire power contact assembly in perspective, according to some exemplary embodiments of the invention.

Reference is now made to FIG. 5B, which shows electrical contacts between one or more contact assemblies 120 of a track 100 and a power contact assembly 520 of a luminaire, according to some exemplary embodiments of the invention. Reference is also made to FIG. 6, which shows electrical contacts of a track 100 and luminaire power contact assembly 520 in perspective, according to some exemplary embodiments of the invention.

In some embodiments, one or more power rails 121 (for example, rails 121A-121D) are provided by a contact assembly 520 within a slot 130. These allow a luminaire to receive power from the track 100 through its own power contact assembly 520. The luminaire power contact assembly 520 comprises mating contacts 521, which are positioned on assembly 520 so that they reach to and form reliable electrical connections 570 with contact assembly 120. Proper spacing, in some embodiments, comprises abutting a portion of a luminaire such as the power contact assembly 520 itself against an appropriately sized spacing element such as protruding member 131.

In some embodiments, the electrical connection between track and luminaire is a low voltage connection (12 volts, for example, or another voltage less than about 50 volts). Potentially, this reduces the chance of arcing between bare portions of rails 121A-121D held in relatively close proximity. In some embodiments, a higher voltage (for example, line voltage of 120 volts, 220 volts, or another voltage) is used. Supply is, for example, AC or DC. In some embodiments, the power rails 121A-121D are arranged with two supply lines and two ground and/or neutral lines. Optionally, both pairs are powered from the same voltage and/or current supply (in constant current or constant voltage mode, according to selected electrical parameters of operation). This is a potential advantage to allow the same luminaire to be inserted in any orientation with respect to the track, and still receive power from the same circuit. Optionally, a plurality of separately controlled power supplies are connected to different pairs of power rails 121A-121D. This has the potential advantage of allowing two separate track lighting control groups along one rail (for example, selected according to an orientation of a luminaire or a portion thereof with respect to the track). Additionally or alternatively, different luminaires are set to operate within different control groups according settings controlled by another means, for example, solid state switching and/or wireless (radio or IR, for example) control. In some embodiments, a portion of the electrical circuit used to power a luminaire includes the material of the track housing 101 itself, and/or another part of the track 100, such as a mounting element 110.

In some embodiments, mating contacts 521 comprise a tensioning means to help ensure constant contact with the power rails 121. In some embodiments, the tensioning means comprises forming a portion of each mating contact 521 as a leaf spring. Additionally or alternatively, a portion of the material to which a mating contact 521 is mounted is configured to urge mating contacts and power rails 121 into contact.

In some embodiments, contact assembly 520 comprises a casing which holds mating contacts 521 within itself. Optionally, casing 520 compresses the springs to a sufficient degree that their outward force to mate with power rails 121 is well developed (for example, about 0.5 N, 1 N, 2 N, or another higher, lower or intermediate force), and maintained reliably over the service lifetime of the luminaire.

Track with Arcuate Mounting Surface, and Mating Luminaire Designs

Figure 3A:
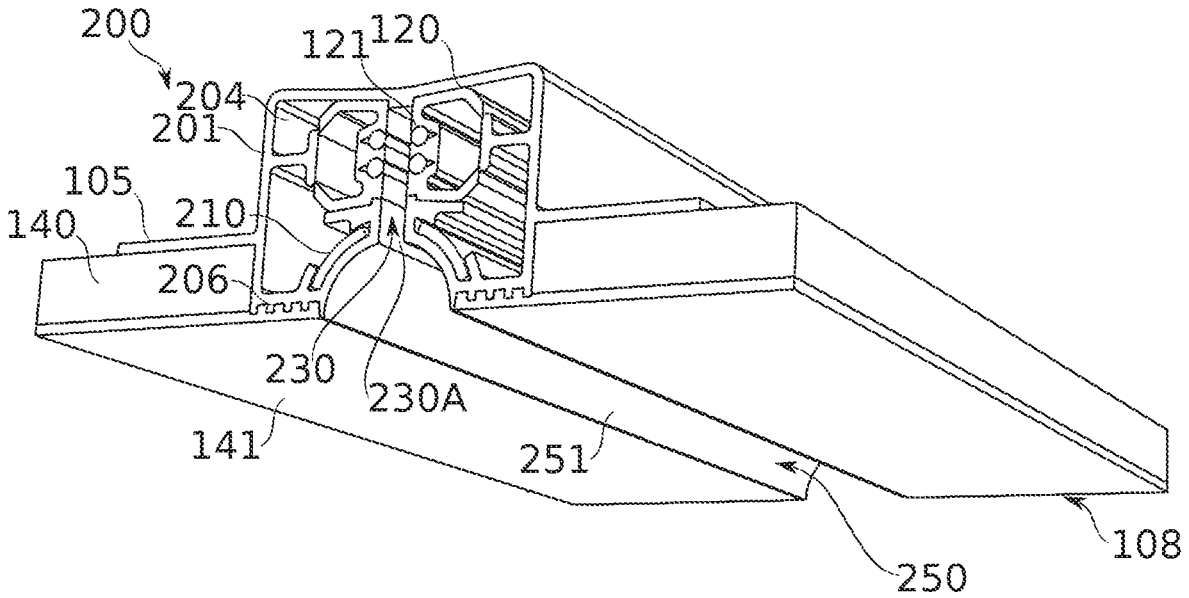
FIG. 3A is a schematic perspective view of a track for a recessed track lighting system, comprising a narrow power access slot and magnetically attracted mounting plates shaped to accommodate an arcuately profiled inset, according to some exemplary embodiments of the invention.
Figure 3B:
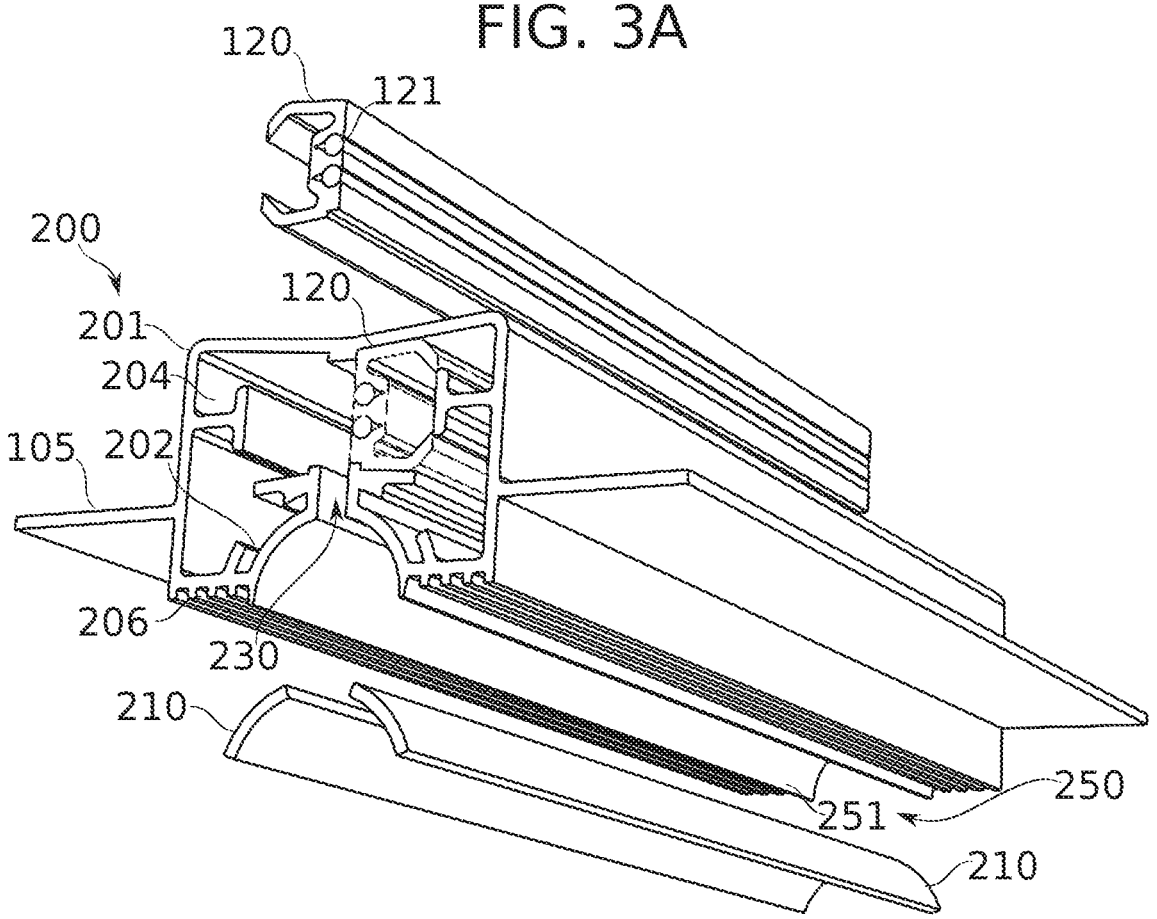
FIG. 3B is a partially exploded schematic perspective view of the track of FIG. 3A, according to some exemplary embodiments of the invention.

Reference is now made to FIG. 3A, which is a schematic perspective view of a track 200 for a recessed track lighting system, comprising a narrow power access slot 230 and magnetically attracted mounting plates 210 shaped to accommodate an arcuately profiled inset 250, according to some exemplary embodiments of the invention. Reference is also made to FIG. 3B, which is a partially exploded schematic perspective view of the track of FIG. 3A, according to some exemplary embodiments of the invention.

In some embodiments of the invention, track 200 comprises track housing 201. Optionally, track housing 201 comprises an extruded aluminum manufacture.

In some embodiments of the invention, track housing 201 comprises an arcuately profiled inset region 250 on a ventral (exposed) side. In some embodiments, the arcuately profiled region comprises an inset portion of a circular arc. Optionally, the arc is non-circular, for example, a portion of an ellipse or other curve. The radius of the inset portion is, for example, in the range of from about 1 cm to about 3 cm; and/or, more particularly, about 1 cm, 1.5 cm, 2 cm, 2.5 cm, or another greater, lesser or intermediate radius. In some embodiments of the invention, the fraction of the circumference subtended by the surface 251 of the inset is about 50%. Optionally, the circumferential fraction subtended is another value, for example, a value ranging from about 10% to about 70% of the circumference defined by an arc radius of the inset region 250, or a circumferential fraction selected from another range having the same, greater, lesser, and/or intermediate values.

In some embodiments of the invention, track 200 comprises one or more mounting elements 210, optionally comprising a magnetically attracted material as described in relation to mounting elements 110.

In some embodiments, track housing 101 includes one or more mounting element slots 202 shaped to receive at least a portion of a mounting element 210, for positioning and/or securing of the mounting element 210 to the track housing 201. For example, mounting element 210 comprises a curved profile shaped to conform to a luminaire mounting surface 251 along inset arcuate region 250. In this example, the mounting elements 210 are hidden behind the mounting surface 251. This is a potential advantage for allowing the appearance of an exposed portion 251 of the track housing 101 to be controlled separately from the material constraints applicable to the mounting element 110.

Figure 5C:
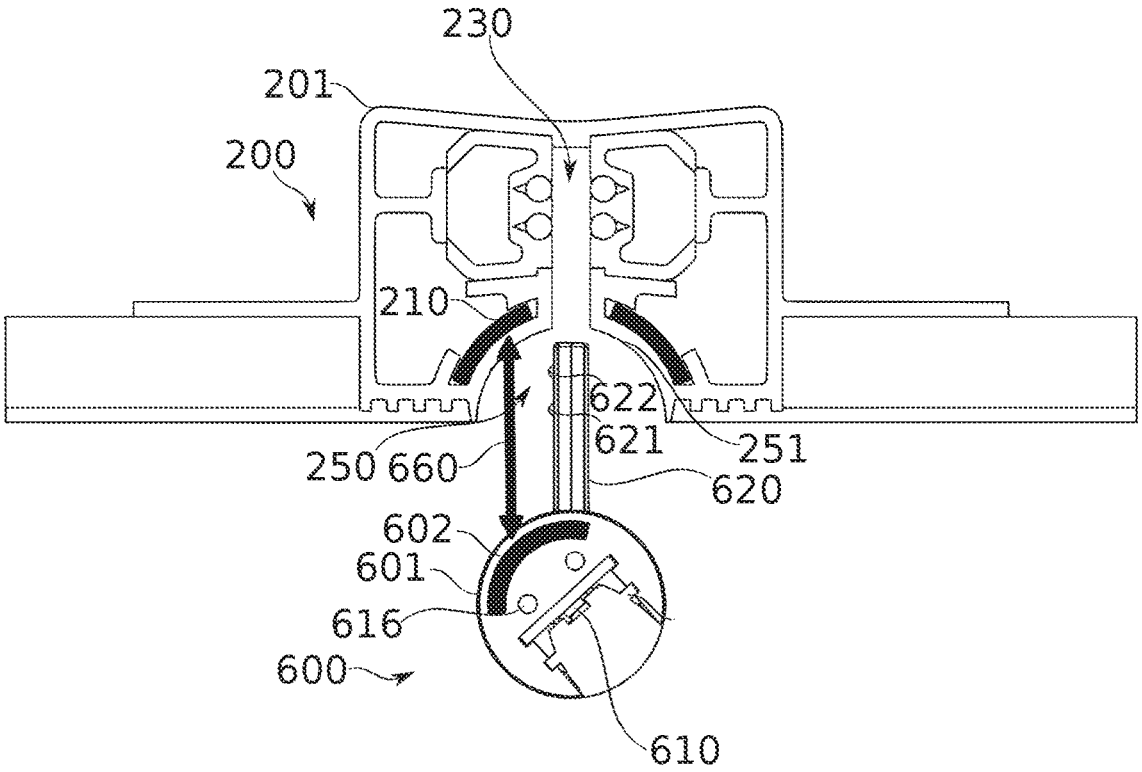
FIG. 5C shows relationship between magnetically susceptible mounting elements of a track, and corresponding magnetically susceptible mounting elements of a luminaire, according to some exemplary embodiments of the invention.
Figure 7:
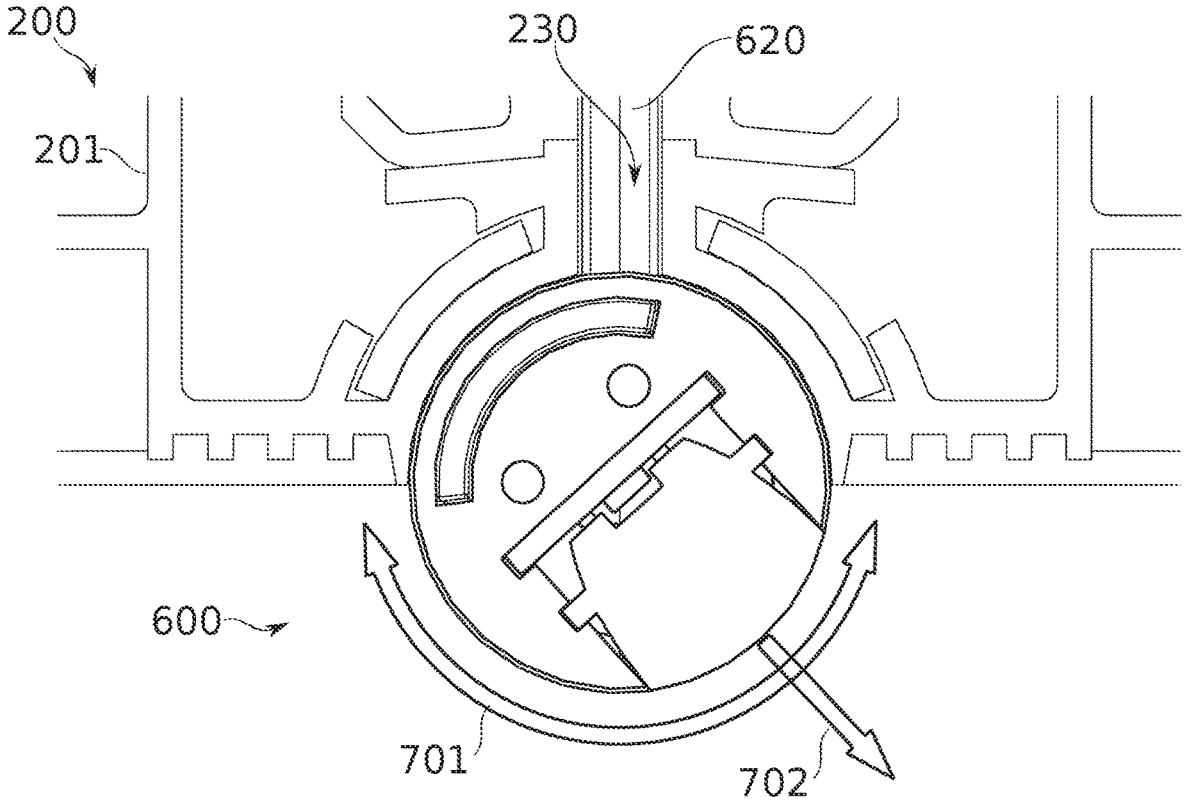
FIG. 7 shows a luminaire having a housing comprising a circular profile sized to the dimensions and shape of a circularly arcuate inset, according to some exemplary embodiments of the invention.

Reference is now made to FIG. 5C, which shows relationship between magnetically susceptible mounting elements 210 of a track 200, and corresponding magnetically susceptible mounting elements 602 of a luminaire 600, according to some exemplary embodiments of the invention. Reference is also made to FIG. 7, which shows a luminaire 600 having a housing 601 comprising a circular profile sized to the dimensions and shape of a circularly arcuate inset 250, according to some exemplary embodiments of the invention.

In some embodiments, a luminaire 600 comprises a housing 601 having an arcuate profile sized to the dimensions of the inset region 250 (or, optionally, any portion of the inset profile dimensions).

As described also in relation to track 100: mounting of a luminaire 600 to track 200, in some embodiments, comprises bringing together track 200 and a housing 601 comprising magnetic mounting means 602 which interact with mounting elements 210 of track 200 (arrow 660 schematically indicates the force of magnetic attraction). Optionally, the magnetic mounting means 602 have a shape complementary to the shape of mounting elements 610. This allows magnetic mating to occur throughout a substantial portion of surface region 251; optionally a surface region portion which is larger than that which would be available from a flat mounting surface. Potentially, this increases stability of mounting.

Optionally, the construction of luminaire 600 allows rotation 701 (FIG. 7) around an axis of the inset region 250, while maintaining a large area of mounting contact with surface 251. Potentially, this adds flexibility in directing an axis of illumination 702 of the luminaire 600, while maintaining good mounting contact.

Figure 8A:
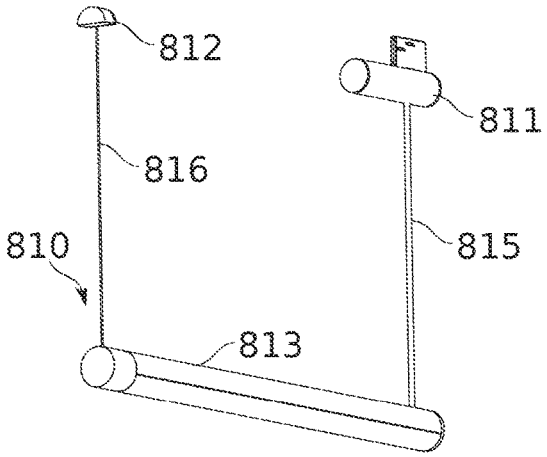
FIGS. 8A-8B schematically illustrate luminaires with separate power, illumination, and/or attachment modules, according to some exemplary embodiments of the invention.
Figure 8B:
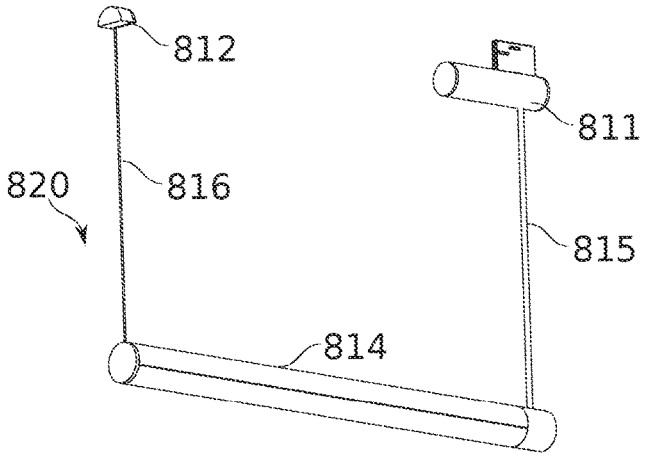
Figure 8C:
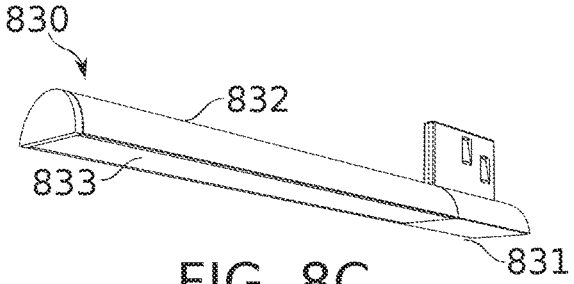
FIGS. 8C-8D schematically illustrate a luminaire having a cross-section sized to the cross-sectional dimensions of an arcuate inset, according to some exemplary embodiments of the invention.
Figure 8D:
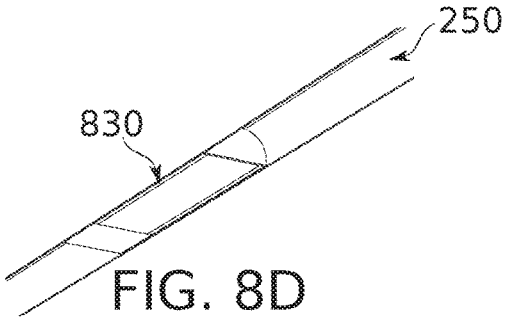
Figure 8E:
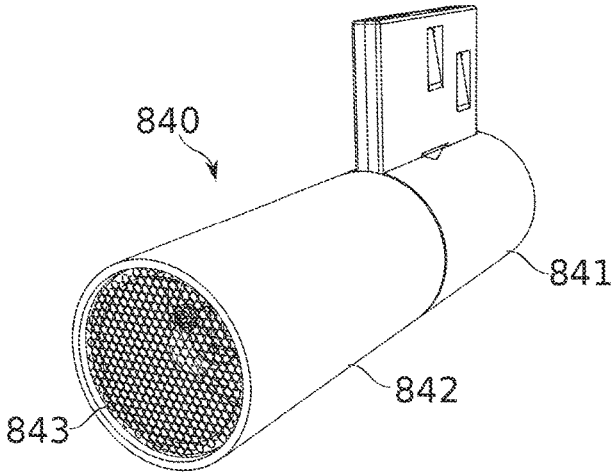
FIGS. 8E-8F show an example of luminaire configured to throw light longitudinally from at least one end along a track, according to some exemplary embodiments of the invention.
Figure 8F:
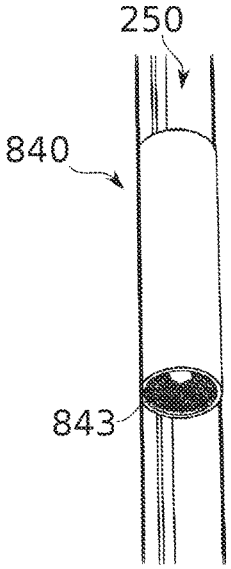
Figure 9B:
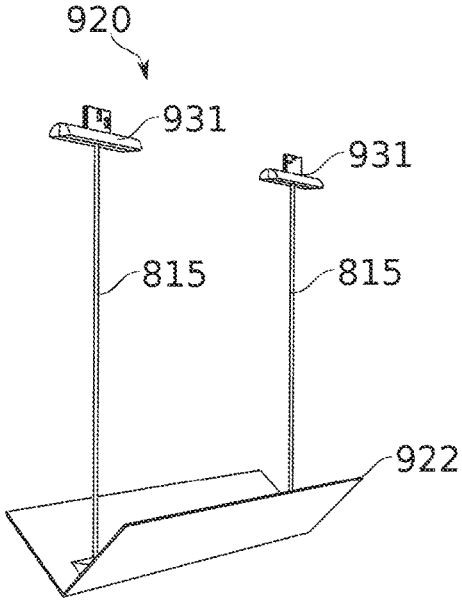
FIGS. 9B-9D show combinations of power, illumination and/or attachment functions in different luminaire designs, according to some exemplary embodiments of the invention.
Figure 9C:
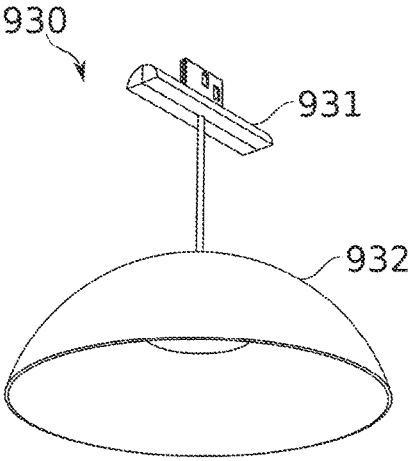
Figure 9D:
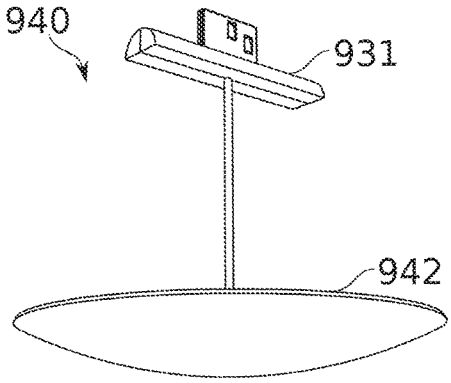
Figure 9E:
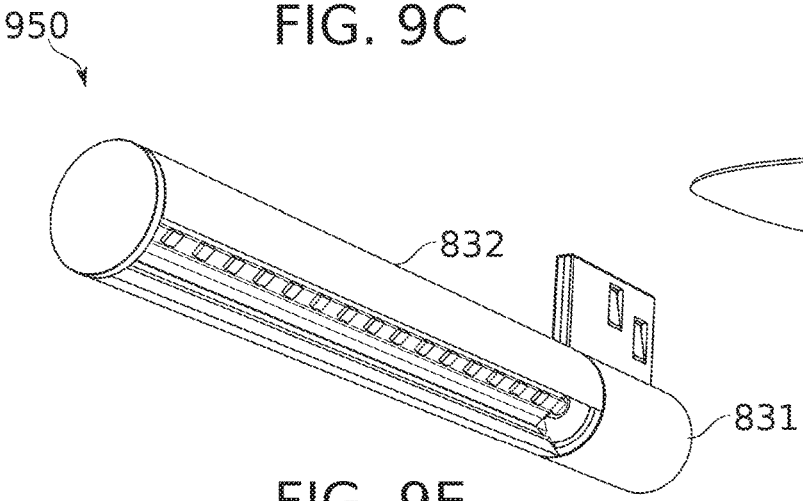
FIG. 9E shows an exemplary luminaire comprising a cylindrical housing, according to some exemplary embodiments of the invention.

Reference is now made to FIG. 9E, which shows an exemplary luminaire 950 comprising a cylindrical housing, according to some exemplary embodiments of the invention. In some embodiments, rotation is provided together with electrical connection by putting illuminating elements 610 on a rotatable portion 832 of the housing 601, while another portion 831 of the housing 601 comprises the luminaire power contact assembly 620. Optionally, the two portions are linked by an internal power connection, for example, a connecting passing through one or more power interconnect lumens 616. Other example of luminaires comprising two such portions include luminaires 830 (portions 832 and 831) and 840 (portions 842 and 841) of FIGS. 8C-8F.

Reference is now made to FIGS. 8C-8D, which schematically illustrate a luminaire 830 having a cross-section sized to the cross-sectional dimensions of an arcuate inset 250, according to some exemplary embodiments of the invention.

In some embodiments, profiles of luminaire 830 and arcuate inset 250 are matched such that all or a portion of the luminaire 830 can be inserted to the inset 250. Potentially, this results in flush-mounted illuminating surface 833. For example, in some embodiments, a semi-circular luminaire 830 (such as a half cylinder) comprises an illuminating surface 833 across an exposed diameter. A semi-circular inset region optionally allows this surface to be placed parallel and flush to the installation surface 108 of the track 200.

It is to be understood that a luminaire profile that fits into arcuate inset region 250 is not necessarily shaped to conform to surface 251. For example, the luminaire optionally conforms at least in part to a smaller radius arc, and/or to a larger radius arc (having a circumference subtending a smaller angle). Although this potentially reduces a degree of magnetic attraction between luminaire and track (due to there being magnetically susceptible portions which cannot completely approach each other), it indicates how more variety of form may be achieved. It should also be noted that although flat track 100 has been described in relation to the mounting thereto of a correspondingly flat-surfaced luminaire (such as luminaire 910), the track is also used, in some embodiments, to receive luminaires of other forms (such as round-bodied luminaire 950). Potentially, this provides a different aesthetic to the lighting system, the shape and the narrow slot combining to give luminaires an "unsupported" look, even though the mounting strength is adequate to the requirements of the installation.

The surface 251 of the arcuate inset region 250 is optionally treated (for example, painted and/or provided with a powder coating) to provide a surface which is matched to its mounted surroundings. Optionally, the surface is countershaded so that the surface treatment blends with the surroundings best under appropriately designed lighting conditions. For example, a powder coating for a region which is to be positioned where it receives less illumination is applied so that it is correspondingly lighter in color, helping to mask and/or change the appearance of the installation.

It should be noted that there are potential aesthetic differences between an arcuate inset region with a thin slot and a single thick "square" slot of a standard track lighting system. The arcuate inset region provides a smooth surface 251 which is potentially interrupted only by the slot, as opposed to an interior which includes potentially visible hardware for mounting and/or electrical power access. The arcuate inset region has a relatively narrow region with a sharp slope difference from the mounting surface, which potentially reduces the width and/or intensity of shadowing changes due to differences of illumination angle. Potentially, the arcuate inset region is provided with a more open form than would be appropriate for a single square slot (where there may be an incentive to hide some internal details), the broader profile helping to reduce shading depth.

Furthermore, the arcuate inset shape is optionally installed as a deliberately visible design element. Optionally, the lighting is chosen to illuminate the track, for example as a decorative accent.

Reference is now made to FIGS. 8E-8F, which show an example of luminaire 840 configured to throw light longitudinally from at least one end 843 along a track 250, according to some exemplary embodiments of the invention. In an example of use, a track comprising inset region 250 is installed to run vertically down a wall, with an installed luminaire 840 acting as a sconce and/or downlight which directs at least a portion of its illumination to emphasize the track it sits in. Potentially, this creates the effect of a relatively sharply defined illuminated wall section. Additionally or alternatively, along-the-track lighting is provided for countershading.

It should be understood, moreover, that a narrow slot is coupled, in some embodiments of the invention, with any open-sided, inset cross-section shape. Thus, the arcuate inset with narrow slot is an example more generally of a "double slot" design concept, where the most visible slot is of any polygonal cross section open on one side, for example, rectangular, triangular, half-hexagon, lobed (starred, for example) or other. In relation to a lobed cross section, for example, it can be noted that the slot is optionally located to be at one of the lobes, such that it is in effect masked by the surrounding lobes. As a further example, some embodiments of the invention comprise a track shaped for vertical mounting at a convex corner where two walls meet, the inset region comprising a "V" (or other shape), and the corresponding luminaire being optionally flush on two sides with a surface of each wall.

In some embodiments, track housing 201 comprises an interior region 230 formed as a slot open through aperture 230A in a ventral side of the track 200. Optionally, aperture 230A is in the surface 251 of the arcuately profiled inset region 250. In some embodiments, the walls of slot 230 comprise surfaces of one or more contact assemblies 120 carrying power rails 121 for bringing power to contacts of a luminaire. For example, the track 200 comprises two contact assemblies 120, each carrying two power rails 121. The contact assemblies 120 occupy corresponding receiving spaces 204 within the track housing 201.

Figure 5D:
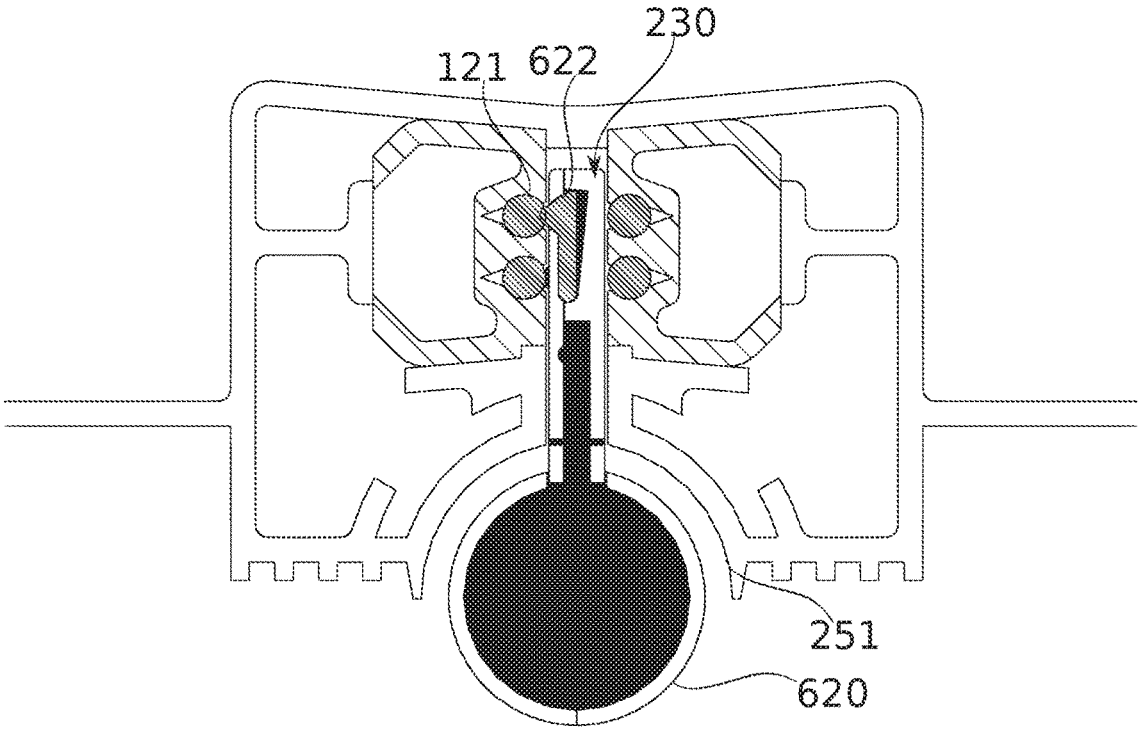
FIG. 5D shows in cutaway details of the interaction of a luminaire contact assembly with a contact assembly, according to some exemplary embodiments of the invention.

Reference is now made to FIG. 5D, which shows in cutaway details of the interaction of a luminaire contact assembly 620 with a contact assembly 120, according to some exemplary embodiments of the invention.

In some embodiments, a portion of contact assembly 620 is sized and shaped to fittingly insert into slot 230, bringing electrodes 621, 622 into contact with power rails 121. In some embodiments, contact assembly 620 is surrounded by a luminaire housing 601 (not shown in FIG. 5D). It should be noted that as the track surface 251 itself bears the force of contact between luminaire and track, a protective standoff region at the aperture to the track is optionally omitted.

As described in relation to track 100, track 200 comprises, in some embodiments, mounting features such as a flange 105 and/or surface irregularities 106.

Alternate Thin Slot Design

Figure 4A:
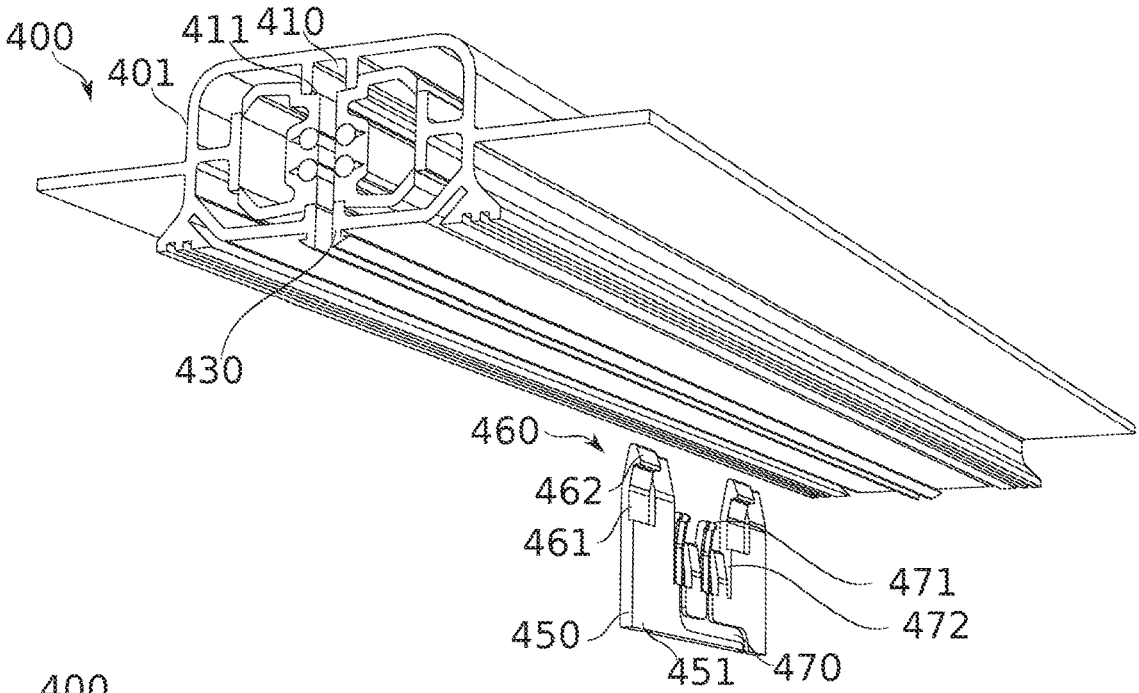
FIGS. 4A-4E schematically illustrate views of a track lighting track having an internal mounting clip receiving space, and a narrow electrical access slot, together with a combined mounting-electrical module for use with track, according to some exemplary embodiments of the invention.
Figure 4B:
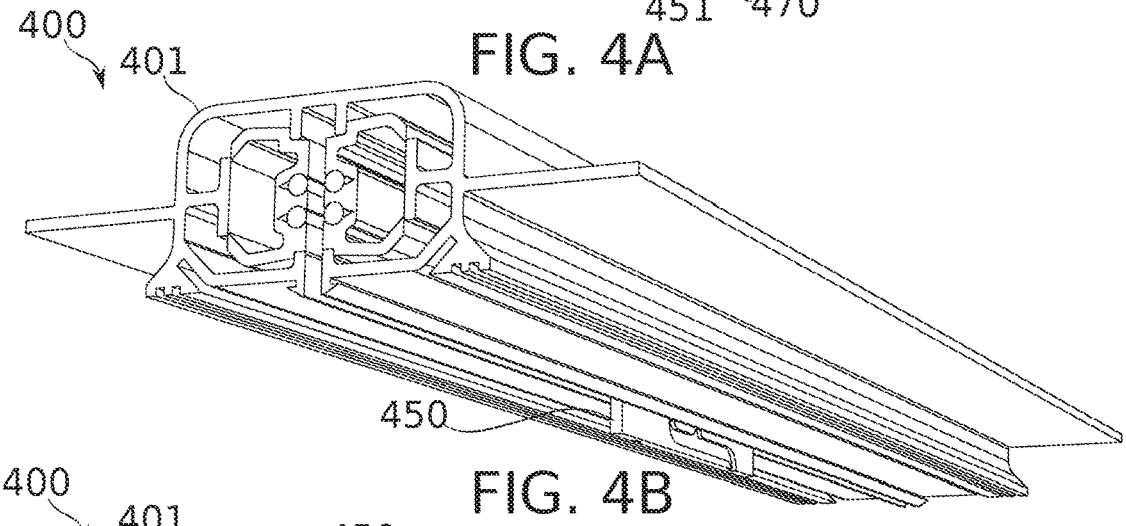
Figure 4C:
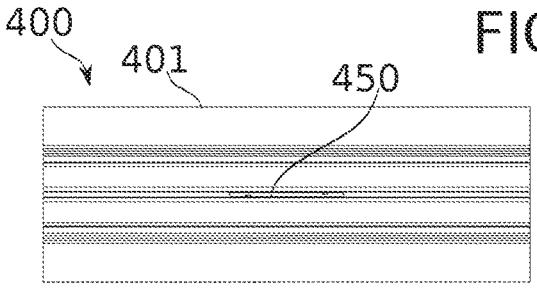
Figure 4D:
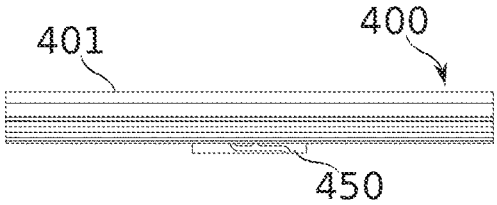
Figure 4E:
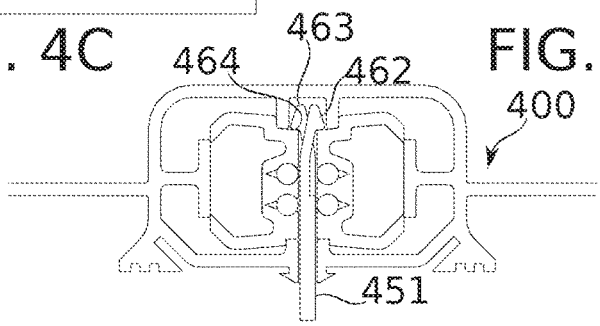
Figure 4F:
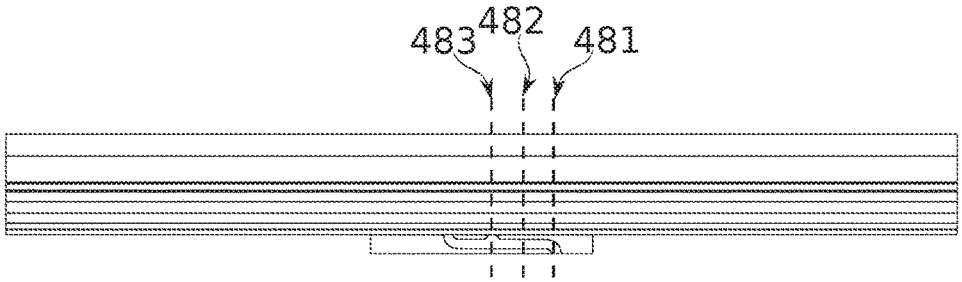
FIG. 4F shows the position of the cross-sectional planes of FIGS. 4G-4I, according to some exemplary embodiments of the invention.
Figure 4G:
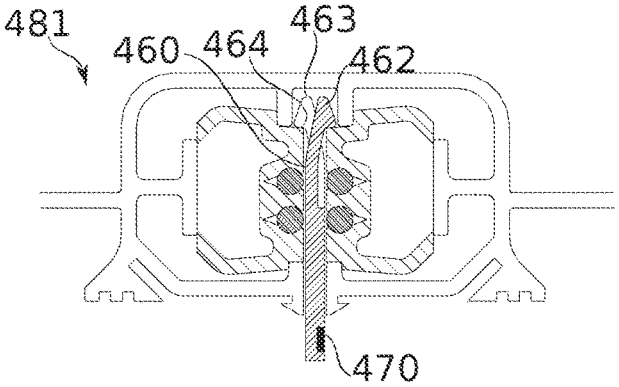
FIGS. 4G-4I schematically illustrate cross-sectional planes through an assembled track and mounting module, according to some exemplary embodiments of the invention.
Figure 4H:
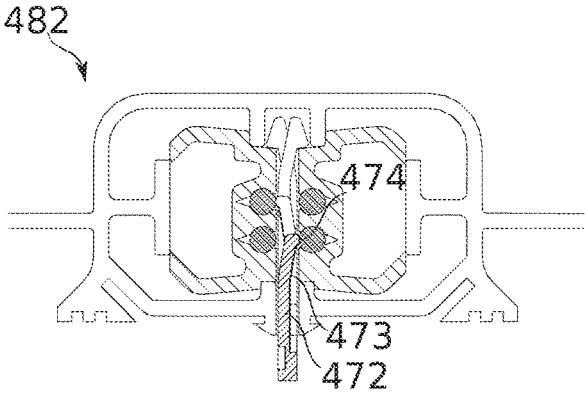
Figure 4I:
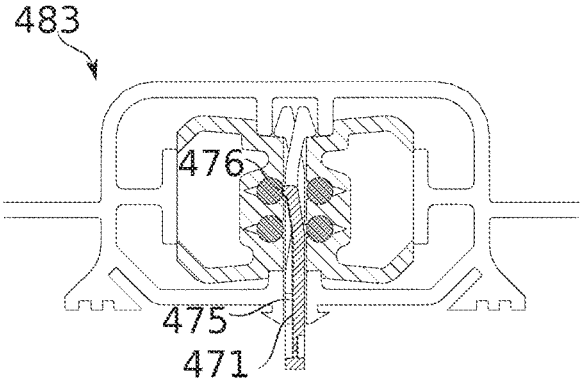

Reference is now made to FIGS. 4A-4E, which schematically illustrate views of a track lighting track 400 having an internal mounting clip receiving space 410, and a narrow electrical access slot 430, together with a combined mounting-electrical module 450 for use with track 400. Reference is also made to FIGS. 4G-4I, which schematically illustrate cross-sectional planes through an assembled track 400 and mounting module 450. Reference is further made to FIG. 4F, which shows the position of the cross-sectional planes of FIGS. 4G-4I.

FIGS. 4A-4I emphasize the connecting and mounting functions of the track; however it is to be understood that module 450 is optionally provided together with any of the luminaire (illumination portion) designs described herein.

Track 400 comprises a track housing 401 which comprises an access slot 430 of, for example, 3 mm or less (for example about 2 mm, 1.5 mm, 1 mm, or another greater, smaller, or intermediate width). The narrow slot dimensions makes it potentially more difficult to provide an encased electrode contact assembly such as that of FIGS. 5B and 5D that will function reliably. In some embodiments, contact module 450 comprises a card body 451 of stiffly elastic insulating material (shown inserted in all of these figures except for FIG. 4A). In some embodiments, the card body 451 comprises, for example, a fiber impregnated thermoset resin such as is used in the manufacture of laminated printed circuit boards. For example, the body material is chosen from among materials such as FR-1, FR-2, FR-3, FR-4, FR-5, FR-6, G-10, CEM-1, CEM-2, CEM-3, CEM-4, CEM-5, and/or another material, such as polycarbonate resin. Optionally, the material is chosen to have sufficient durability to withstand long periods of under flexed compression and/or wide temperature range without loss of restorative force.

In some embodiments, the card body 451 comprises one or more tongue-like protrusions 460, 471, 472 which protrude generally along but at least partially beyond the volume defined by the main flat surfaces of the main card body 451 (except when the tongues are compressed). Optionally, manufacture of the tongues comprises cutting away thicknesses of an original stock to leave a thinner card body (for example, a 3-mm thick body), with protrusions left beyond this thickness where required. Additionally or alternatively, the card material is cast, layered, and/or cured with a bend already imparted to the material.

In some embodiments, clip members 460 are provided for mechanical mounting of a luminaire. The cross section 481 of FIG. 4G is through an exemplary clip member 460, and elements of such a clip member are also labeled in FIGS. 4A and 4E.

Optionally, clip members are provided in one or more pairs, each element of the pair being shaped to engage with an opposite wall of the track 400: for example, shaped to engage a ledge 411 inside clip receiving space 410. Each clip member 460 is formed with a relatively thin and elongated neck 461 leading to a retaining head 462. Each retaining head 462 is narrow enough to pass through slot 430, while the overall clip member 460 is sufficiently compressible to follow behind. Upon entering the relatively open area of clip receiving space 410, the retaining head 462 springs outward and braces, for example, against ledge 411. In some embodiments, retaining head 462 is shaped with a relatively narrow leading end 463 so that the head becomes aligned with the slot opening upon being pressed thereto during insertion.

In some embodiments, retaining head 462 is shaped with an incline on the trailing edge 464, the incline 464 being shaped so that with sufficient pulling force during removal, the interaction of the incline with one or more edges (such as ledge 411) within the clip receiving space 410 forces the retaining head 462 back into alignment with slot 430. So-aligned, the retaining head 462 can be removed. Additionally or alternatively, retaining head 462 is held in place by friction with a surface of the clip receiving space 410.

In some embodiments, the retrieval force required to remove the luminaire from the slot 430 is about 3× greater than the weight of the luminaire which module 450 supports (or another factor such as about 2×, 3.5×, 5×, or another greater or lesser factor). In some embodiments, the retrieval force is in the range of about, for example, 5-10 N, 5-15 N, 10-15 N, 10-20 N, 15-30 N, or another range having the same, greater, smaller, and/or intermediate bounds.

In some embodiments, contact module 450 is provided with one or more surfaces 470 in card 451 (for example, a ground channel and a voltage/current supply channel), optionally surfaces of channels. The surfaces are at least partially filled, coated, plated, arc sprayed, flame sprayed, vacuum metalized, and/or otherwise provided with a conductive material (metal). Optionally, the process used is a process known in the manufacture of printed circuit boards, and/or the metallization of plastic.

In some embodiments, plating reaches along contact protrusions 471, 472, which are optionally formed as smaller tongues than those of clip member 460. The cross section 482 of FIG. 4H is through an exemplary contact protrusion 472, and cross section 483 of FIG. 4I is through an exemplary contact protrusion 471.

In some embodiments, metal plating 473, 475 of each contact 472, 471 extends to a region 474, 476 which is pressed against a power rail 121 when the contact module 450 is fully inserted into the track slot 430. Arrangements of voltages and other options for power connection are optionally provided as described, for example, in relation to the arrangements of FIGS. 5B and 5D.

It is to be understood that although the clip mount (comprising space 410 and clips 460) and the tongue contact mechanism (comprising contacts 471, 472, electrode channel 470, and electrodes housed therein) have been presented in the context of a single embodiment, they are provided separately in some embodiments. For example, the tongue contacts 472 are provided with a magnetic mount such as one described hereinabove, and/or the clip mount 410, 460 is provided together with an electrical contact module similar to module 520 and/or 620.

Luminaire Designs Having Separable Modules

Reference is now made to FIGS. 8A-8B, which schematically illustrate luminaires with separate power, illumination, and/or mounting modules, according to some exemplary embodiments of the invention. Reference is also made to FIGS. 9B-9D, which show combinations of power, illumination and/or attachment functions in different luminaire designs, according to some exemplary embodiments of the invention.

In some embodiments, functions of a luminaire and/or its interaction with the track are divided into two, three, or more modules. For example, FIGS. 8A-8B and 9B show embodiments of a longitudinally extended luminaire 810, 820, 920, where the illuminating section 813, 814, 922 depends at either end from two corresponding modules 812, 811, 931 which mount to and/or provide an electrical interface with a track such as track 100 or track 200. Module 812, for example, comprises a half-round (semicircular) body, optionally provided with magnetic means such as described herein above for luminaire 600. From module 812 depends a cord 816 which is provided for mechanical support of its end. Modules 811 and 931 comprise a full-round (circular) and half-round (semicircular) body, respectively, provided with both mounting and electrical interface means, for example as described in relation to the embodiments of other luminaires herein, including those of FIGS. 1A-1B, 3A-3B, and/or 4A-4I. Cord 815 optionally comprises both wires for electrical power transmission to the illuminating sections 813, 814, 922, and mechanical support of one end. Luminaires 813 and 814 are shown differing from one another in length. Luminaire 920 shows a different overall shape of the illuminating portion 922, and is an example of a luminaire comprising two separate electrical as well as physical connections to the track.

Luminaires 930 and 940 illustrate examples of single-attachment luminaires, where attachment and electrical interfacing are both managed by one module 931, while the illuminating sections 932, 942 which hang from them are shaped according to any design compatible with the load bearing capacity of the module (or modules, since more than one load bearing module is optionally provided to obtain appropriate bearing capacity). In some embodiments, the load bearing capacity of a module (with an appropriate safety factor of, for example, about 5×) is, for example, about 0.5 kg, 1 kg, 1.5 kg, 2 kg, or another larger, smaller, or intermediate load bearing capacity.

It is to be understood that the shapes shown are exemplary only, and not limited to the particulars shown. For example, any of the modules is optionally replaced by a semicircular, circular, rectangular block, or other shaped housing, for example, any shape described herein.

It is expected that during the life of a patent maturing from this application many relevant illumination sources will be developed and the scope of the term luminous element is intended to include all such new technologies a priori.

As used herein, the term "about" refers to within ±10%.

The terms "comprises", "comprising", "includes", "including", "having" and their conjugates mean: "including but not limited to".

The term "consisting of" means: "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

The words "example" and "exemplary" are used herein to mean "serving as an example, instance or illustration". Any embodiment described as an "example or "exemplary" is not necessarily to be construed as preferred or advantageous over other embodiments and/or to exclude the incorporation of features from other embodiments.

The word "optionally" is used herein to mean "is provided in some embodiments and not provided in other embodiments". Any particular embodiment of the invention may include a plurality of "optional" features except insofar as such features conflict.

As used herein the term "method" refers to manners, means, techniques and procedures for accomplishing a given task including, but not limited to, those manners, means, techniques and procedures either known to, or readily developed from known manners, means, techniques and procedures by practitioners of the chemical, pharmacological, biological, biochemical and medical arts.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6, etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

What is claimed is:

1. A track for mounting electrically powered fixtures of a track lighting system, the track comprising:

an elongate track housing formed from a non-magnetic material;

a slot in and extending along a longitudinal axis of the housing comprising a first interior lateral surface and a second interior lateral surface, the two surfaces defining between them an interior volume;

at least one electrical conductor, forming a portion of at least one of the interior lateral surfaces, and positioned to receive a lateral contact from a power contact assembly of a fixture upon insertion of the power contact assembly to the interior volume of the slot, and configured for delivery of electrical power through the contact; and magnetically attracted material extending along the track housing, and positioned to support the fixture by magnetic attraction.

2. The track of claim 1, wherein the magnetically attracted material comprises strips mounted along each lateral side of an opening of the slot and laterally separated across the opening of the slot.

3. The track of claim 1, wherein the magnetically attracted material is positioned to form a ventral surface of the track.

4. The track of claim 3, wherein the track is configured to be mounted to an architectural mounting surface, with the ventral surface extending substantially parallel to the architectural mounting surface.

5. The track of claim 3, wherein the track is provided with flanges for mounting to an architectural mounting surface, with the ventral surface extending substantially flush with the architectural mounting surface.

6. The track of claim 3, wherein the magnetically attracted material is formed as a strip having surface irregularities configured to increase stability of adhesion of a surface treatment.

7. The track of claim 6 comprising at least one of divots, bumps, and ridges along the ventral surface extent.

8. The track of claim 6, wherein the surface irregularities are spaced at intervals of about 1-10 mm.

9. The track of claim 3, wherein the magnetically attracted material is formed as a strip with perforations along the ventral surface extent.

10. The track of claim 1, wherein the magnetically attracted material is formed as a strip comprising two plate regions and an angle bend along the longitudinal axis connecting the two plate regions.

11. The track of claim 1, wherein the magnetically attracted material is held wholly within the track housing.

12. The track of claim 11, wherein the magnetically attracted material is positioned within the track housing where it is magnetically attracted to the fixture through a thickness of the non-magnetic material of the housing.

13. The track of claim 1, wherein the magnetically attracted material comprises steel.

14. The track of claim 1, wherein the track housing is formed of extruded aluminum.

15. The track of claim 1, wherein an opening of the slot through which the power contact assembly is inserted is 8 mm wide or less along at least 90% of the track housing.

16. The track of claim 15, wherein the opening of the slot is 5 mm wide or less.

17. The track of claim 15, wherein the opening of the slot is 3 mm wide or less.

18. The track of claim 1, wherein the slot includes a region configured to receive and support weight of the fixture without magnetic attraction, wherein the weight is transferred to the region through the power contact assembly.

19. A fixture configured for use with the track of claim 1, comprising a magnet and a power contact assembly; wherein the power contact assembly is configured to be inserted to the slot of the track and receive power from the track via a contact made along a lateral side of the fixture; and wherein the magnet is configured to be supported by magnetic attraction to the magnetically attracted material.

20. The fixture of claim 19, wherein the fixture is a luminaire.

* * * * *